US009128456B2

(12) United States Patent
Kamimura

(10) Patent No.: US 9,128,456 B2
(45) Date of Patent: Sep. 8, 2015

(54) IMAGE FORMING APPARATUS HAVING EXPOSURE UNIT MOVING MECHANISM

(71) Applicant: Naoya Kamimura, Ichinomiya (JP)

(72) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/048,393

(22) Filed: Oct. 8, 2013

(65) Prior Publication Data

US 2014/0037332 A1 Feb. 6, 2014

Related U.S. Application Data

(63) Continuation of application No. 13/329,959, filed on Dec. 19, 2011, now Pat. No. 8,583,004.

(30) Foreign Application Priority Data

Dec. 27, 2010 (JP) ..... 2010-290305
Dec. 27, 2010 (JP) ..... 2010-290306

(51) Int. Cl.
*G03G 21/16* (2006.01)

(52) U.S. Cl.
CPC ..... *G03G 21/1671* (2013.01); *G03G 21/1633* (2013.01); *G03G 21/1666* (2013.01); *G03G 21/1676* (2013.01)

(58) Field of Classification Search
CPC ..... G03G 21/1623; G03G 21/1633; G03G 21/1666; G03G 21/1671; G03G 21/1676
USPC ..... 399/4, 110, 118, 124, 107; 347/152
See application file for complete search history.

(56) References Cited

U.S. PATENT DOCUMENTS 6,381,428 B1 4/2002 Yamamoto et al.
6,697,586 B2 2/2004 Yamamoto et al.
6,708,011 B2 3/2004 Nomura et al.
7,227,562 B2 * 6/2007 Asuwa et al. ..... 347/138

(Continued)

FOREIGN PATENT DOCUMENTS

EP 1098228 A2 5/2001
EP 1273980 A2 1/2003

(Continued)

OTHER PUBLICATIONS

Office Action received in corresponding Japanese Application No. 2010-290305 mailed on Jan. 22, 2013.

(Continued)

*Primary Examiner* — David Gray
*Assistant Examiner* — Carla Therrien
(74) *Attorney, Agent, or Firm* — Banner & Witcoff, Ltd.

(57) ABSTRACT

A cam member has each of a plurality of first exposure-side surfaces provided in association with a first contact part of each exposure units and each of a plurality of second exposure-side surfaces provided in association with each first contact part. Each first contact part confronts but separates from the corresponding first exposure-side surface when the corresponding exposure unit is disposed in an adjacent position where the exposure unit is capable of exposing the corresponding photosensitive drum. Each first contact part is in contact with the corresponding second exposure-side surface when the corresponding exposure unit is disposed in a retracted position positioned farther than the adjacent position from the photosensitive drum.

19 Claims, 13 Drawing Sheets

(56) References Cited

U.S. PATENT DOCUMENTS

| | | | | |
|---|---|---|---|---|
| 7,551,877 | B2 | 6/2009 | Murayama | |
| 7,792,464 | B2 | 9/2010 | Okabe et al. | |
| 8,014,699 | B2 * | 9/2011 | Tamaru | 399/112 |
| 8,150,294 | B2 | 4/2012 | Okabe et al. | |
| 8,583,004 | B2 * | 11/2013 | Kamimura | 399/110 |
| 8,718,513 | B2 * | 5/2014 | Tamaru | 399/112 |
| 2003/0053819 | A1 | 3/2003 | Nomura et al. | |
| 2003/0091368 | A1 | 5/2003 | Yamamoto et al. | |
| 2004/0165910 | A1 | 8/2004 | Sato et al. | |
| 2005/0074259 | A1 * | 4/2005 | Tachiki et al. | 399/121 |
| 2005/0238385 | A1 | 10/2005 | Kang et al. | |
| 2007/0048007 | A1 | 3/2007 | Kamimura | |
| 2007/0126852 | A1 | 6/2007 | Fukutome et al. | |
| 2007/0286639 | A1 | 12/2007 | Murayama | |
| 2008/0304860 | A1 | 12/2008 | Hisada | |
| 2009/0087209 | A1 | 4/2009 | Yamaguchi | |
| 2009/0092412 | A1 | 4/2009 | Kei | |
| 2009/0142092 | A1 | 6/2009 | Sato | |
| 2009/0269101 | A1 | 10/2009 | Okabe et al. | |
| 2010/0021201 | A1 * | 1/2010 | Tamaru | 399/113 |
| 2010/0183352 | A1 | 7/2010 | Hisada | |
| 2011/0286766 | A1 * | 11/2011 | Tamaru | 399/119 |
| 2011/0299882 | A1 | 12/2011 | Tanaami et al. | |
| 2012/0114374 | A1 | 5/2012 | Suzuki | |
| 2012/0183319 | A1 | 7/2012 | Sato et al. | |
| 2012/0183324 | A1 | 7/2012 | Sato et al. | |

FOREIGN PATENT DOCUMENTS

| | | | |
|---|---|---|---|
| JP | 2001-175046 | A | 6/2001 |
| JP | 2003-076106 | A | 3/2003 |
| JP | 2003-107838 | A | 4/2003 |
| JP | 2004-258138 | A | 9/2004 |
| JP | 2005189322 | A | 7/2005 |
| JP | 2006-285296 | A | 10/2006 |
| JP | 2007-041124 | A | 2/2007 |
| JP | 2007058067 | A | 3/2007 |
| JP | 2007-086482 | A | 4/2007 |
| JP | 2007-328300 | A | 12/2007 |
| JP | 04-187262 | B1 | 11/2008 |
| JP | 2008-275805 | A | 11/2008 |
| JP | 2009080394 | A | 4/2009 |
| JP | 2009092914 | A | 4/2009 |
| JP | 2009-122391 | A | 6/2009 |
| JP | 2009-157135 | A | 7/2009 |
| JP | 2009265128 | A | 11/2009 |
| JP | 2010165000 | A | 7/2010 |
| JP | 2010-271743 | A | 12/2010 |

OTHER PUBLICATIONS

Notice of Allowance issued in corresponding U.S. Appl. No. 13/329,959 mailed Jul. 8, 2013.

Office Action issued in corresponding Chinese Patent Application No. 201110446864.2 mailed Jan. 28, 2014.

Oct. 7, 2014—(JP) Office Action—App. 2010-290306.

* cited by examiner

IMAGE FORMING APPARATUS HAVING EXPOSURE UNIT MOVING MECHANISM

CROSS REFERENCE TO RELATED APPLICATION

This application is a continuation of U.S. application Ser. No. 13/329,959, filed Dec. 19, 2011, which claims priority from Japanese Patent Applications No. 2010-290305 filed Dec. 27, 2010 and No. 2010-290306 filed Dec. 27, 2010. The entire contents of the above-noted applications are incorporated herein by reference.

TECHNICAL FIELD

The present invention relates to an image-forming apparatus.

BACKGROUND

A color printer with an LED exposure system is known in the art as one type of electrophotographic color printer. This color printer is provided with four photosensitive drums corresponding to the colors yellow, magenta, cyan, and black, and four LED units for respectively exposing the photosensitive drums.

One such color printer that has been proposed includes a main casing, and a process cartridge that is detachably mounted in the casing. The process cartridge is provided with drum cartridges for retaining the photosensitive drums, and developer cartridges that are detachably mounted on the drum cartridges for retaining developing rollers. The printer also includes LED units for exposing the photosensitive drums. The process cartridge is mounted in and removed from the printer through an opening formed in the top surface of the main casing by opening a top cover provided thereon.

SUMMARY

However, when employing an LED exposure system, the LED units must be disposed in proximity to the photosensitive drums in order to expose the same. Consequently, when replacing the photosensitive drums, the LED units must be temporarily retracted from their positions near the photosensitive drums, requiring a mechanism for retracting the LED units from and returning the LED units to their positions near the photosensitive drums.

The conventional printer described above achieves this mechanism by incorporating the LED units in the top cover. The LED units are thus separated from and returned near the photosensitive drums in association with the opening and closing operations of the top cover.

However, when the LED units and the mechanism for moving the LED units relative to the photosensitive drums are provided in the top cover, the structure of the top cover becomes complex and heavy and can make the operations for opening and closing the top cover more troublesome.

Therefore, it is an object of the present invention to provide an image-forming apparatus with a simple structure for separating the exposure units from and returning the exposure units near the photosensitive drums.

In order to attain the above and other objects, the invention provides an image-forming apparatus includes a plurality of photosensitive drums, a plurality of exposure units, and a cam member. The plurality of photosensitive drums is arranged parallel to one another and spaced at intervals. Each of the plurality of exposure units is provided for each photosensitive drum. Each of the plurality of exposure units is configured to be moved between an adjacent position where the exposure unit is capable of exposing the corresponding photosensitive drum and a retracted position positioned farther than the adjacent position from the photosensitive drum. The cam member is configured to move the plurality of exposure units between the adjacent position and the retracted position. Each of the exposure units includes a first contact part that is capable of contacting the cam member. The cam member has each of a plurality of first exposure-side surfaces provided in association with each first contact part and each of a plurality of second exposure-side surfaces provided in association with each first contact part. Each first contact part confronts but separates from the corresponding first exposure-side surface when the corresponding exposure unit is disposed in the adjacent position. Each first contact part is in contact with the corresponding second exposure-side surface when the corresponding exposure unit is disposed in the retracted position.

DETAILED DESCRIPTION

1. Overall Structure of a Color Printer

Figure 1:
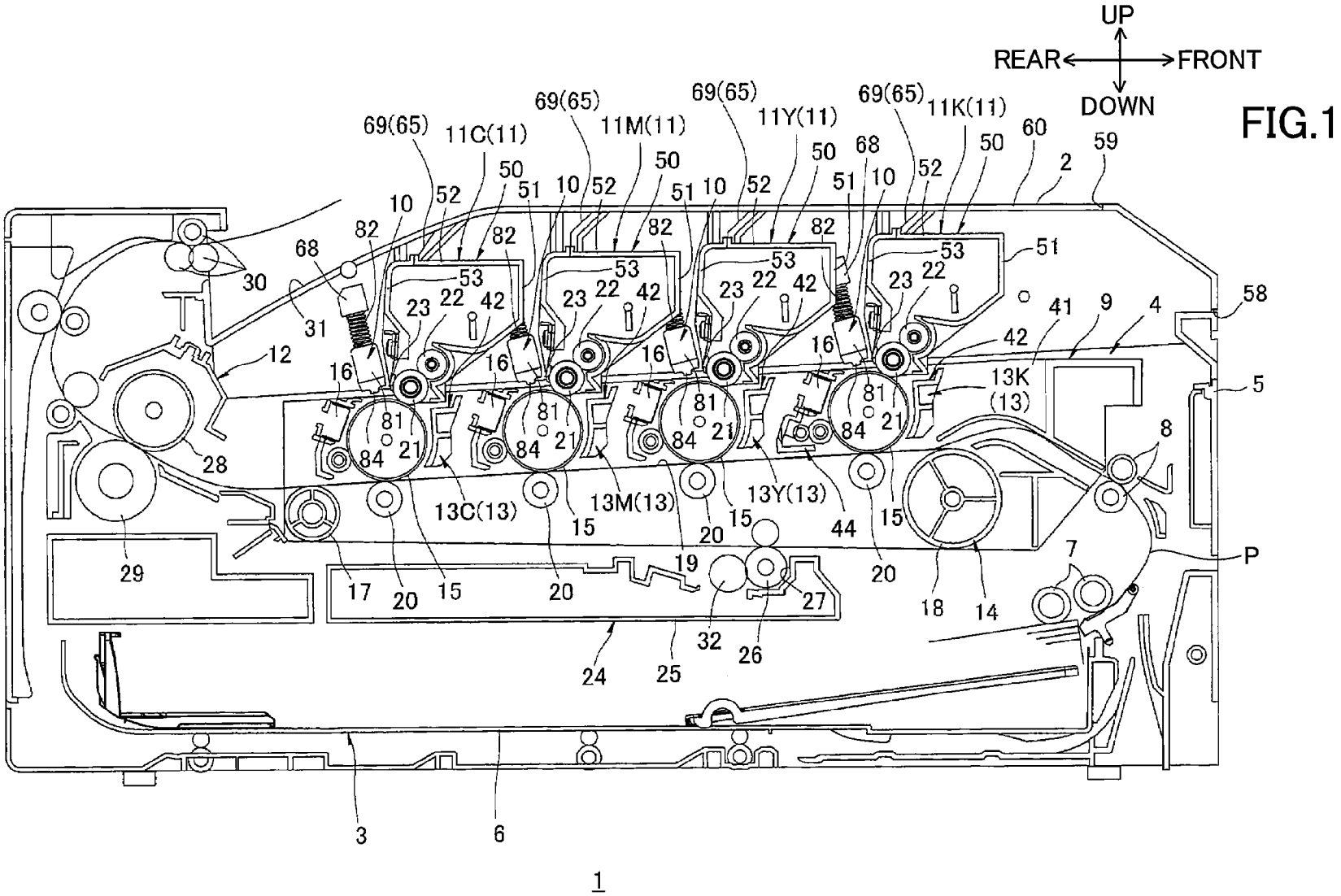
FIG. 1 is a cross-sectional view of a direct tandem color printer according to a first embodiment of the present invention.

As shown in FIG. 1, a color printer 1 serving as a first embodiment of the image-forming apparatus according to the present invention is a horizontal direct tandem color printer. The color printer 1 includes a main casing 2 and, within the main casing 2, a sheet-feeding unit 3 for feeding sheets of a paper P, and an image-forming unit 4 for forming images on the sheets of paper P fed by the sheet-feeding unit 3.

(1) Main Casing

The main casing 2 is box-shaped and substantially rectangular in a side view. The main casing 2 accommodates the sheet-feeding unit 3 and image-forming unit 4. An access opening 58 serving as an example of first opening is formed in one side wall of the main casing 2. A front cover 5 serving as an example of first cover is provided on the main casing 2 over the access opening 58. The front cover 5 can be pivoted about its bottom edge between a closed position covering the access opening 58 and an open position exposing the access opening 58.

In the following description, the side of the main casing 2 on which the front cover 5 is provided (the right side in FIG. 1) will be referred to as the "front side," and the opposite side (the left side in FIG. 1) as the "rear side." Left and right sides of the main casing 2 in the following description will be based on the perspective of a user facing the front side of the color printer 1. Thus, the near side in FIG. 1 will be referred to as the "left side" and the far side as the "right side."

(2) Sheet-Feeding Unit

The sheet-feeding unit 3 includes a paper tray 6 that accommodates sheets of the paper P. The paper tray 6 is detachably mounted in the bottom section of the main casing 2. A pair of feeding rollers 7 is disposed above the front end of the paper tray 6. A pair of registration rollers 8 is disposed above the feeding rollers 7.

The feeding rollers 7 rotate to feed sheets of paper P from the paper tray 6 toward the registration rollers 8 one sheet at a time, and the registration rollers 8 convey the sheets toward the image-forming unit 4 (between photosensitive drums 15 and a conveying belt 19 described later) at a prescribed timing.

(3) Image-Forming Unit

The image-forming unit 4 is disposed above the sheet-feeding unit 3. The image-forming unit 4 includes a drawer unit 9 serving as an example of moving member, a belt cleaning unit 24, four developer cartridges 11 corresponding to the four printing colors, four LED units 10, serving as an example of exposure units, corresponding to the four printing colors, and a fixing unit 12.

(3-1) Drawer Unit

The drawer unit 9 retains four drum units 13 corresponding to the four printing colors, and a transfer unit 14 serving as an example of belt unit. The drawer unit 9 is disposed so as to be capable of sliding in the front and rear directions between a mounted position in which the drawer unit 9 is fully mounted in the main casing 2, and a withdrawn position in which the drawer unit 9 is withdrawn outside of the main casing 2.

The drum units 13 are arranged parallel to one another and spaced at intervals in the front-to-rear direction. The drum units 13 include a black drum unit 13K, a yellow drum unit 13Y, a magenta drum unit 13M, and a cyan drum unit 13C arranged from front-to-rear in the given order. Each drum unit 13 includes a photosensitive drum 15, and a Scorotron charger 16.

The photosensitive drum 15 has a cylindrical shape and is oriented with its longitudinal axis in the left-to-right direction. The Scorotron charger 16 is disposed diagonally above and to the rear of the corresponding photosensitive drum 15. The Scorotron charger 16 opposes but does not contact the photosensitive drum 15.

The transfer unit 14 is disposed beneath the drum units 13 and extends in the front-to-rear direction. The transfer unit 14 serving as an example of belt unit includes a drive roller 17, a follow roller 18 serving as an example of a pair of rollers, an endless conveying belt 19 serving as an example of endless belt, and four transfer rollers 20. The drive roller 17 and follow roller 18 are arranged parallel to each other and separated in the front-to-rear direction.

The conveying belt 19 is looped around the drive roller 17 and follow roller 18 so that the outer surface on the upper portion of the conveying belt 19 vertically opposes the photosensitive drums 15 and contacts the same. When the drive roller 17 is driven to rotate, the conveying belt 19 circularly moves so that the upper portion contacting the photosensitive drums 15 moves rearward.

Each of the transfer rollers 20 is disposed in confrontation with the corresponding photosensitive drum 15, with the upper portion of the conveying belt 19 interposed therebetween.

(3-2) Belt Cleaning Unit

The belt cleaning unit 24 is disposed beneath the drawer unit 9. The belt cleaning unit 24 includes a waste toner collecting unit 25, a belt cleaning roller 26 serving as an example of cleaning member, and a scraping roller 32.

The waste toner collecting unit 25 is formed substantially in a box shape. An opening 27 is formed in the top of the waste toner collecting unit 25 near the front end thereof. The belt cleaning roller 26 is rotatably supported in the opening 27 of the waste toner collecting unit 25.

The belt cleaning unit 24 is disposed such that the belt cleaning roller 26 contacts the outer surface on the lower portion of the conveying belt 19. The belt cleaning roller 26 of the belt cleaning unit 24 cleans toner and other matter deposited on the outer surface of the conveying belt 19. The scraping roller 32 scrapes the toner and the like picked up by the belt cleaning roller 26 so that the toner and the like falls and is collected in the waste toner collecting unit 25.

(3-3) Developer Cartridges

The developer cartridges 11 are arranged at intervals in the front-to-rear direction at positions above the corresponding photosensitive drums 15. The developer cartridges 11 include a black developer cartridge 11K, a yellow developer cartridge 11Y, a magenta developer cartridge 11M, and a cyan developer cartridge 11C arranged from front to rear in the order given.

Each developer cartridge 11 includes a developing roller 21 serving as an example of developer supporting member. Each developing roller 21 is rotatably supported in the bottom end of the corresponding developer cartridge 11 so as to be exposed through the bottom (lower rear side) thereof. The developing roller 21 contacts the top of the corresponding photosensitive drum 15.

The developer cartridge 11 includes a supply roller 22 for supplying toner to the developing roller 21, and a thickness-regulating blade 23 for regulating the thickness of toner carried on the developing roller 21. Toner, serving as an example of developer, of a corresponding color is accommodated in each developer cartridge 11 within a space formed in the developer cartridge 11 above the supply roller 22.

(3-4) LED Units

The LED units 10 are disposed above the drawer unit 9 at positions to the rear of the corresponding developer cartridges 11. The LED units 10 confront the tops of the corresponding photosensitive drums 15. Each LED unit 10 irradiates light onto the surface of the corresponding photosensitive drum 15 based on prescribed image data.

(3-5) Fixing Unit

The fixing unit 12 is disposed to the rear of the drawer unit 9. The fixing unit 12 includes a heating roller 28, and a pressure roller 29 confronting the heating roller 28.

(3-6) Image-Forming Operation (3-6-1) Developing Operation

Toner accommodated in each developer cartridge 11 is supplied to the corresponding supply roller 22, which in turn supplies toner to the corresponding developing roller 21. The thickness-regulating blade 23 regulates the thickness of toner carried on the developing roller 21 as the developing roller 21 rotates so that a thin layer of toner having a uniform thickness is carried on the surface of the developing roller 21. The toner supplied to the developing roller 21 is positively tribocharged when passing beneath the thickness-regulating blade 23.

In the meantime, each of the Scorotron chargers 16 applies a uniform positive charge to the surface of the corresponding photosensitive drum 15 as the photosensitive drum 15 rotates. Subsequently, the corresponding LED unit 10 irradiates light on the positively charged surface, thereby forming an electrostatic latent image on the surface of the photosensitive drum 15 corresponding to an image to be formed on the paper P.

As the photosensitive drum 15 continues to rotate, the positively charged toner carried on the surface of the developing roller 21 is supplied to the latent image formed on the surface of the photosensitive drum 15. The toner supplied by the developing roller 21 develops the latent image into a visible image, producing a toner image on the surface of the photosensitive drum 15 through reversal development.

(3-6-2) Transferring and Fixing Operations

Sheets of paper P supplied from the sheet-feeding unit 3 onto the top surface of the conveying belt 19 are conveyed rearward by the conveying belt 19 and sequentially pass through transfer positions located between each photosensitive drum 15 and the opposing transfer roller 20. While the sheet is conveyed rearward through each transfer position, toner images carried on the photosensitive drums 15 in their respective colors are sequentially transferred onto the paper P to form a color image.

After the color image is transferred onto the sheet of paper P, the sheet is conveyed to the fixing unit 12. The color image is fixed to the sheet by heat and pressure as the sheet passes between the heating roller 28 and pressure roller 29.

(4) Paper Discharging Operation

Discharge rollers 30 are disposed downstream of the fixing unit 12. After the toner image has been fixed on the sheet in the fixing unit 12, the discharge rollers 30 discharge the sheet into a discharge tray 31 formed on the top surface of the main casing 2.

Figure 2:
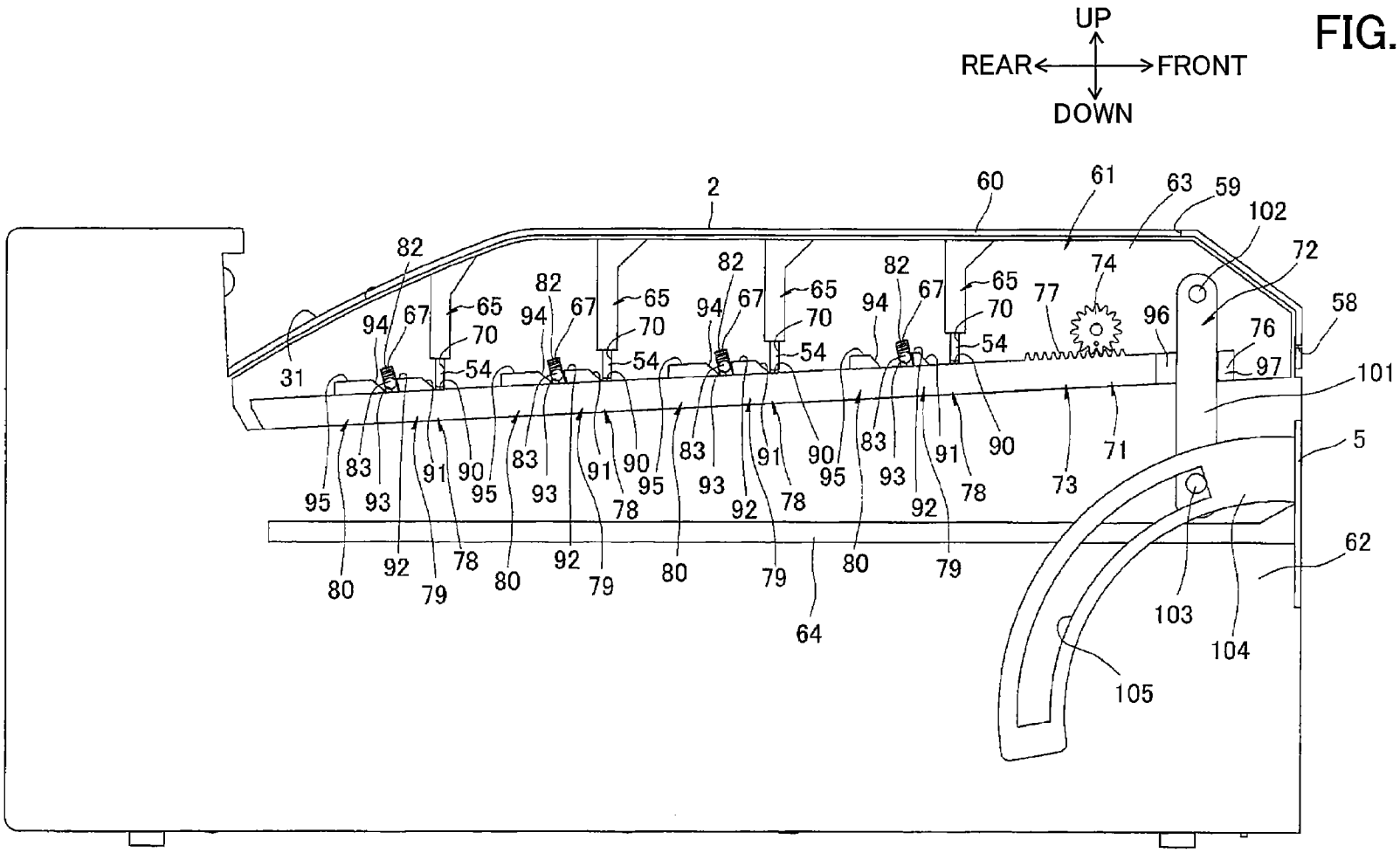
FIG. 2 is an outer-side view of an inner wall of the color printer shown in FIG. 1 in a left-to-right direction.
Figure 3:
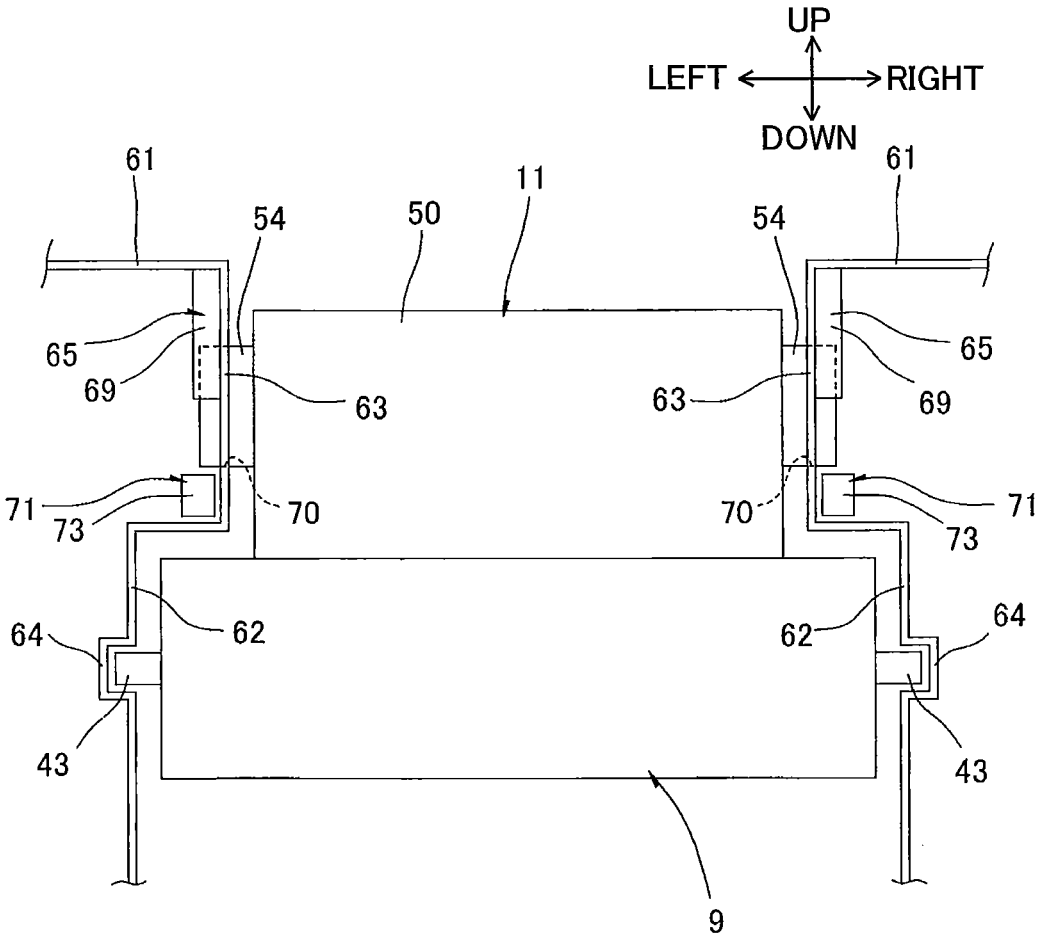
FIG. 3 is an explanatory diagram showing a state that a developer cartridge shown in FIG. 1 is supported by a main casing.

2. Detailed Description of the Main Casing (1) Structures for Supporting the Drawer Unit, Developer Cartridges, and LED Units As shown in FIGS. 2 and 3, a pair of left and right inner walls 61 is provided in the main casing 2. The inner walls 61 define a space for accommodating the developer cartridges 11 and the drawer unit 9. The inner walls 61 are arranged parallel to each other and spaced apart in the left-to-right direction. Each inner wall 61 is configured of a drawer-side inner wall 62 confronting the drawer unit 9, and a developer-side inner wall 63 confronting the developer cartridges 11. The developer-side inner wall 63 is formed continuously with the top of the corresponding drawer-side inner wall 62 while expanding farther inward from the drawer-side inner wall 62 in the left-to-right direction.

A drawer guide part 64 is formed in each drawer-side inner wall 62 for guiding the drawer unit 9 when the drawer unit 9 is mounted or removed. The drawer guide part 64 is a groove-like recess formed substantially in the vertical center of the drawer-side inner wall 62 and extends along the front-to-rear direction. The drawer guide part 64 is formed in the inner surface of the drawer-side inner wall 62 so as to be recessed further outward than the inner surface of the drawer-side inner wall 62 in the left-to-right direction. The vertical width of the drawer guide part 64 is large enough to receive drawer guide bosses 43 (described later) formed on each of the left and right sides of the drawer unit 9.

In each developer-side inner wall 63 are formed developer cartridge guide parts 65 for guiding the developer cartridges 11 when the developer cartridges 11 are mounted or removed, LED support parts 68 (see FIG. 1) for supporting the LED units 10, and LED guide parts 67 for guiding movement of the LED units 10. The developer cartridge guide part 65 serves as an example of guide part.

Four of the developer cartridge guide parts 65 are formed in each developer-side inner wall 63 at intervals in the front-to-rear direction such that the positions of the developer cartridge guide parts 65 correspond to the positions of the developer cartridges 11. Each developer cartridge guide part 65 has a guide groove 69, and an exposure opening 70.

Each of the guide grooves 69 is a groove-like recessed part formed in the inner surface of the corresponding developer-side inner wall 63 and recessed outward with respect to the left-to-right direction. The guide grooves 69 extend from the top edge to the bottom edge of the developer-side inner wall 63 such that both top and bottom ends of the guide grooves 69 are open. The front-to-rear width of each guide groove 69 is wide enough to receive a developer cartridge guide rib 54 (described later) of the corresponding developer cartridge 11.

Each of the exposure openings 70 penetrates the developer-side inner wall 63 to form an opening that is substantially rectangular in shape in a side view. The rectangular shaped exposure opening 70 extends vertically and is in communication with the bottom end of the corresponding guide groove 69.

One LED support part 68 is formed to the rear of each developer cartridge guide part 65. The LED support parts 68 are formed in a squared columnar shape that protrudes inward in the left-to-right direction from the inner surface of the corresponding developer-side inner wall 63.

One LED guide part 67 is formed beneath each LED support part 68. The LED guide parts 67 penetrate the developer-side inner wall 63 to form an elongated hole extending vertically (and more precisely along a direction connecting the lower front side of the developer-side inner wall 63 to the upper rear side of the same).

(2) Translation Cam Mechanism (2-1) Structure of the Translation Cam Mechanism

Figure 5:
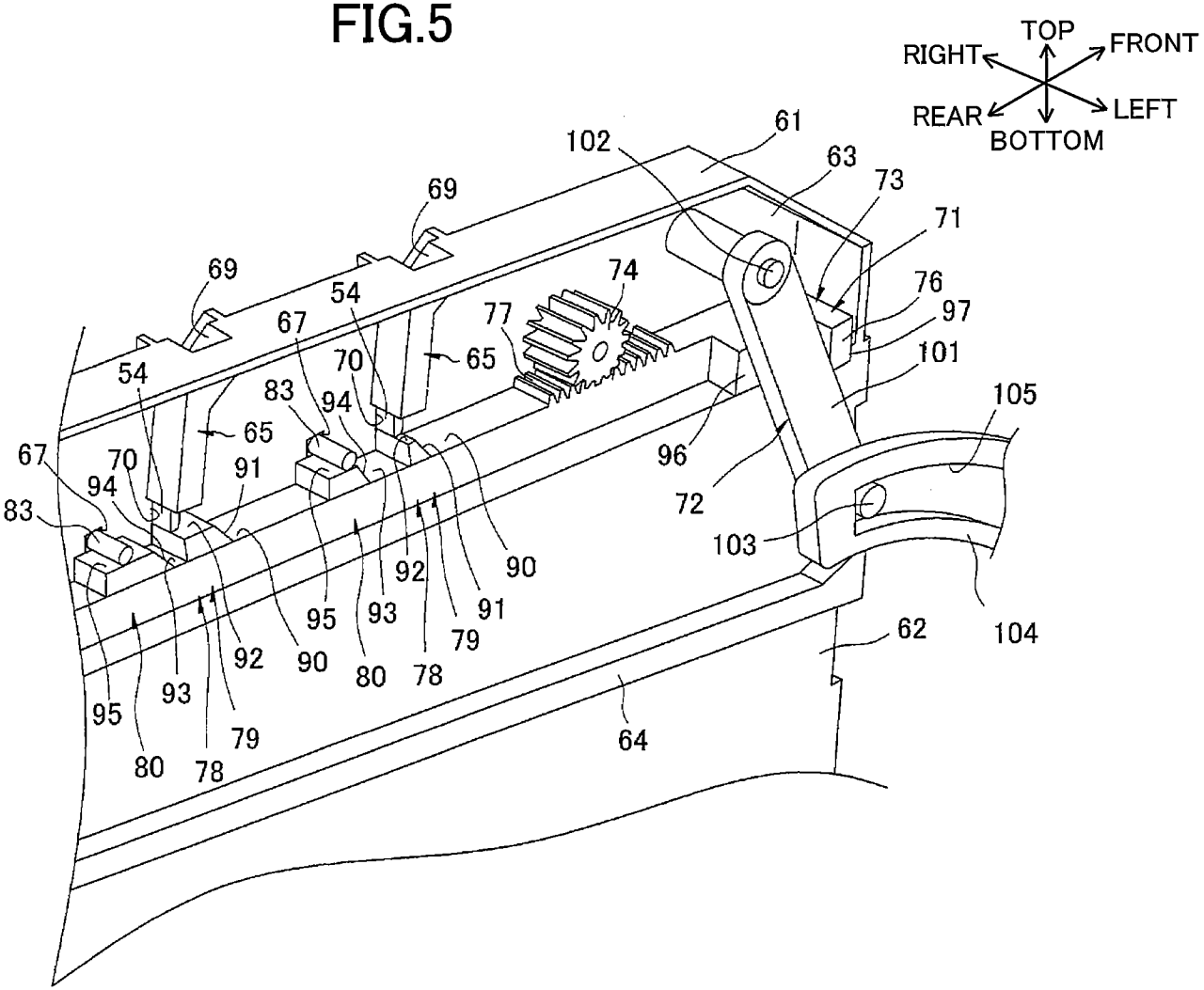
FIG. 5 is an explanatory diagram showing the interlocking mechanism for interlocking movement of translation cams with movement of the front cover, in which engaging parts of the translation cams contact engaging parts of the interlocking mechanism.

As shown in FIG. 5, the main casing 2 is provided with translation cam mechanisms 71, one on each of the left and right outer sides of the developer-side inner walls 63. Each translation cam mechanism 71 includes a translation cam 73 serving as an example of cam member, and a translation cam drive gear 74.

Each translation cam 73 is substantially rod-shaped and extends in the front-to-rear direction. The translation cam 73 is disposed on the lower edge portion of the corresponding developer-side inner wall 63 and is slidable in the front-to-rear direction. The translation cam 73 includes an engaging part 76 that engages with a pivoting member 101 (described later) of an interlocking mechanism 72 (described later), a rack gear 77 engaged with the translation cam drive gear 74, and four cam parts 78.

The engaging part 76 is provided on the front end of the translation cam 73 and extends in the front-to-rear direction so as to form a step part that expands outward in the left-to-right direction from the front end of the translation cam 73. More specifically, the engaging part 76 includes a first step part 96 expanding outward from the front end of the translation cam 73 in the left-to-right direction, and a second step part 97 expanding outward from the front end of the first step part 96 in the left-to-right direction. When projected vertically, the first step part 96 is formed such that its outer end with respect to the left-to-right direction is substantially flush with the outer end of the drawer-side inner wall 62 in the same direction. Similarly, when projected vertically, the second step part 97 is formed such that its outer end with respect to the left-to-right direction protrudes farther outward than the outer end of the drawer-side inner wall 62 in the same direction.

The rack gear 77 is provided on the rear of the engaging part 76 and is formed at a prescribed length in the front-to-rear direction. The prescribed length corresponds to the distance in which the translation cam 73 moves. The rack gear 77 has gear teeth formed in the top surface thereof.

The cam parts 78 are disposed rearward of the rack gear 77 and arranged in a series in the front-to-rear direction. Each cam part 78 includes a developer-side cam part 79 corresponding to one of the developer cartridges 11, and an LED-side cam part 80 corresponding to one of the LED units 10.

Each of the developer-side cam parts 79 is substantially L-shaped, extending in the front-to-rear direction and protruding upward from the rear end thereof. Specifically, the developer-side cam part 79 includes a developer-side opposing surface 90 constituting the top surface of the developer-side cam part 79 and extending rearward from the front edge of the same, a developer-side sloped surface 91 extending continuously from the rear edge of the developer-side opposing surface 90 along a slope angled upward and rearward, and a developer-side pressing surface 92 extending continuously rearward from the rear edge of the developer-side sloped surface 91. The developer-side opposing surface 90 serves as an example of first developer-side surface, the developer-side sloped surface 91 serves as an example of third developer-side surface, and the developer-side pressing surface 92 serves as an example of second developer-side surface.

The developer-side opposing surface 90 of the developer-side cam part 79 disposed farthest forward has a greater front-to-rear length than the developer-side opposing surfaces 90 of the other developer-side cam parts 79, while the developer-side pressing surface 92 of the developer-side cam part 79 disposed farthest forward is shorter in the front-to-rear direction by a length equivalent to this difference in front-to-rear lengths of the developer-side opposing surfaces 90.

The LED-side cam part 80 is also substantially L-shaped, extending continuously in the front-to-rear direction from the rear edge of the corresponding developer-side cam part 79 with its rear end protruding upward. Specifically, the LED-side cam part 80 includes an LED-side opposing surface 93 constituting the top surface of the LED-side cam part 80 and extending rearward from the front edge of the same, an LED-side sloped surface 94 extending continuously from the rear end of the LED-side opposing surface 93 along a slope angled upward and rearward, and an LED-side pressing surface 95 extending continuously rearward from the rear edge of the LED-side sloped surface 94. The LED-side opposing surface 93 serves as an example of first exposure-side surface, the LED-side sloped surface 94 serves as an example of third exposure-side surface, the LED-side pressing surface 95 serves as an example of second exposure-side surface.

The LED-side opposing surface 93 of the LED-side cam part 80 disposed farthest forward is longer in the front-to-rear direction than the LED-side opposing surfaces 93 of the other LED-side cam parts 80, while the LED-side pressing surface 95 of the LED-side cam part 80 disposed farthest forward is shorter in the front-to-rear direction by a length equivalent to this difference in front-to-rear lengths of the LED-side opposing surfaces 93.

The translation cam drive gear 74 is provided on the outer surface of the developer-side inner wall 63 with respect to the left-to-right direction, at a position above the front end of the translation cam 73. The translation cam drive gear 74 is engaged with the rack gear 77 of the translation cam 73 and is capable of rotating relative to the developer-side inner wall 63.

The translation cam drive gear 74 is engaged in the front end of the rack gear 77 when the translation cam 73 is in its rearmost position, and is engaged in the fear end of the rack gear 77 when the translation cam 73 is in its forwardmost position.

(2-2) Operations of the Translation Cam Mechanism

The translation cam mechanism 71 slides the translation cam 73 in front and rear directions through the rotation of the translation cam drive gear 74. The translation cam 73 is moved between a rearwardmost first position (see FIG. 2), a forwardmost second position (see FIG. 9), and an intermediate third position between the first and second positions (see FIG. 11).

When the translation cam 73 is in the first position shown in FIG. 2, the developer cartridge guide rib 54 (described later) of each developer cartridge 11 is disposed in a position confronting but not contacting (separating from) the corresponding developer-side opposing surface 90 from above, while an LED guide boss 83 (described later) of each LED unit 10 is disposed in a position confronting but not contacting (separating from) the corresponding LED-side opposing surface 93 from above.

If the translation cam drive gear 74 is rotated counterclockwise in a left-side view at this time, the translation cam 73 slides forward from the first position, and the developer cartridge guide ribs 54 (described later) of all non-black developer cartridges 11 are forced upward along the developer-side sloped surfaces 91 of the developer-side cam parts 79. Additionally, the LED guide bosses 83 (described later) of the LED units 10 corresponding to all non-black photosensitive drums 15 are pressed upward by the LED-side sloped surfaces 94 of the LED-side cam parts 80.

When the translation cam 73 is slid farther forward into the third position shown in FIG. 11, the developer cartridge guide ribs 54 (described later) of all non-black developer cartridges 11 are in contact with the front edges of the developer-side pressing surfaces 92 formed on the corresponding developer-side cam parts 79. Additionally, the LED guide bosses 83 (described later) of the LED units 10 corresponding to all non-black photosensitive drums 15 are in contact with the front edges of the LED-side pressing surfaces 95 formed on the corresponding LED-side cam parts 80.

Note that at this time the developer cartridge guide rib 54 (described later) of the black developer cartridge 11K confronts but does not contact the developer-side opposing surface 90 of the corresponding developer-side cam part 79. Further, the LED guide boss 83 (described later) of the LED unit 10 corresponding to the black photosensitive drum 15 confronts but does not contact the LED-side opposing surface 93 of the corresponding LED-side cam part 80.

When the translation cam drive gear 74 is rotated further counterclockwise in a left side view from this state, the translation cam 73 is slid forward from the third position. At this time, the developer cartridge guide rib 54 (described later) of the black developer cartridge 11K is pressed upward along the developer-side sloped surface 91 of the corresponding developer-side cam part 79, and the LED guide boss 83 (described later) of the LED unit 10 corresponding to the black photosensitive drum 15 is pressed upward along the LED-side sloped surface 94 of the corresponding LED-side cam part 80.

When the translation cam 73 is slid farther forward into the second position shown in FIG. 9, the developer cartridge guide rib 54 described later of the black developer cartridge 11K is in contact with the developer-side pressing surface 92 of the corresponding developer-side cam part 79. In addition, the LED guide boss 83 (described later) of the LED unit 10 corresponding to the black photosensitive drum 15 is in contact with the LED-side pressing surface 95 of the corresponding LED-side cam part 80.

Note that at this time the developer cartridge guide ribs 54 (described later) of all non-black developer cartridges 11 are in contact with the rear edges of the developer-side pressing surfaces 92 formed on the corresponding developer-side cam parts 79. Additionally, the LED guide bosses 83 (described later) of the LED units 10 corresponding to non-black photosensitive drums 15 are in contact with the rear edges of the LED-side pressing surfaces 95 formed on the corresponding LED-side cam parts 80.

(3) Interlocking Mechanism

As described above, the front cover 5 is provided on the front side of the main casing 2 for covering and exposing the access opening 58. The main casing 2 is also provided with the interlocking mechanism 72 for interlocking movement of the translation cam mechanisms 71 with movement of the front cover 5.

Figure 4:
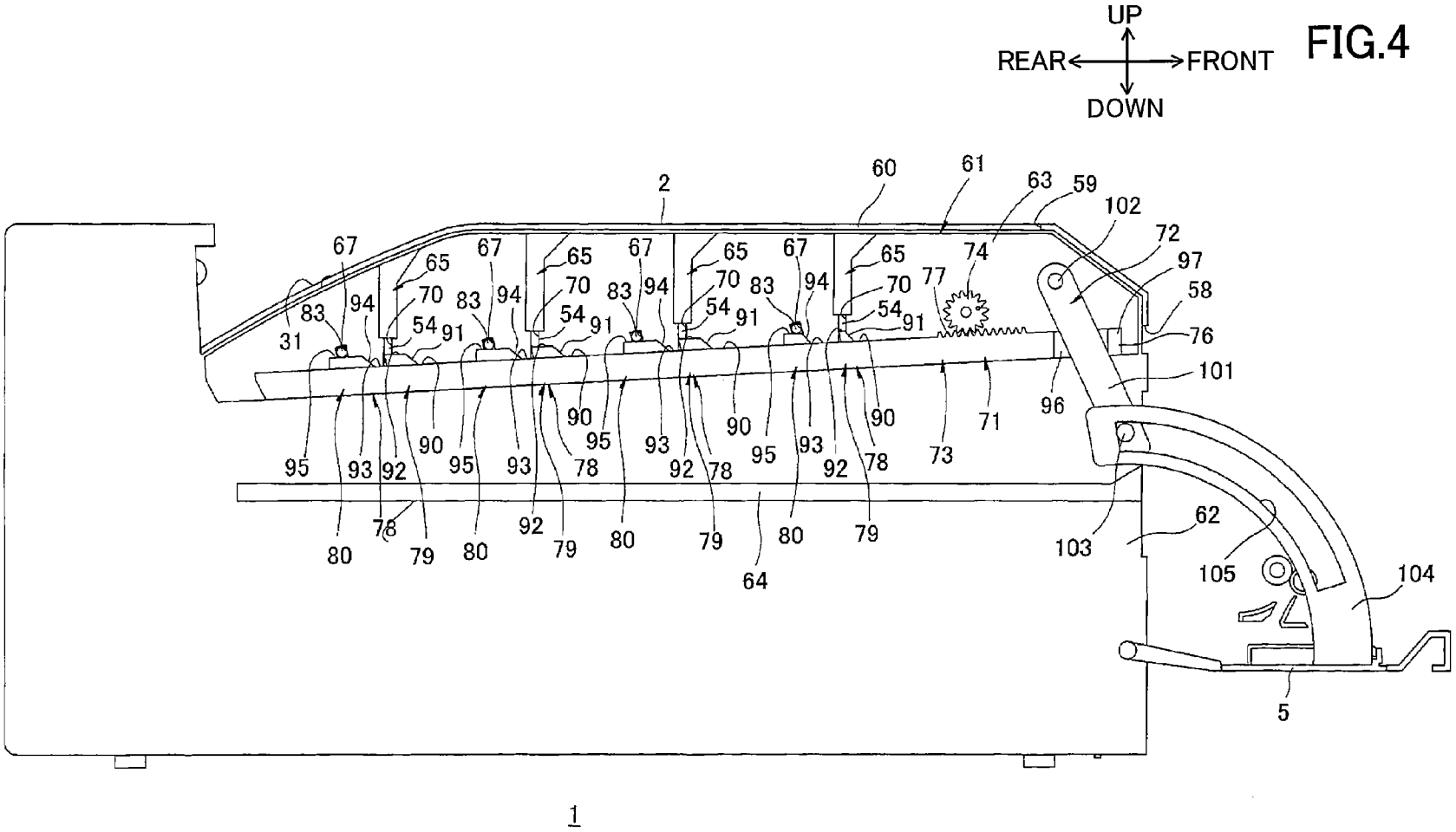
FIG. 4 is an explanatory diagram showing an interlocking mechanism for interlocking movement of translation cams and movement of a front cover, in which the translation cams are placed in a second position in association with opening movement of the front cover.

As shown in FIGS. 2, 4, and 5, the interlocking mechanism 72 includes pivoting members 101, and arms 104. The pivoting members 101 are substantially rod-shaped. One of the pivoting members 101 is pivotably provided on the outer side of each developer-side inner wall 63 with respect to the left-to-right direction. The pivoting members 101 can pivot about pivot shafts 102 disposed above the front ends of the translation cams 73. The pivoting members 101 normally hang vertically downward from the pivot shafts 102, passing over the respective left and right outer sides of the first step parts 96 constituting the translation cams 73 and to the rear of the second step parts 97 constituting the translation cams 73.

A substantially cylindrical boss 103 is formed on the lower end of each pivoting member 101 and protrudes outward from the same with respect to the left-to-right direction.

The arms 104 are substantially arc-shaped in a side view, curving downward and rearward from the rear surface of the front cover 5 as shown in FIG. 2. A coupling hole 105 is formed in each arm 104 for slidably receiving the boss 103 of the corresponding pivoting member 101. The coupling holes 105 are formed in an arc shape.

When the front cover 5 is closed as shown in FIG. 2, the pivoting members 101 hang downward along the vertical, and the bosses 103 of the pivoting members 101 are positioned in the front ends of the corresponding coupling holes 105.

When the front cover 5 is opened, as shown in FIG. 4, the lower ends of the pivoting members 101 are pulled forward by the rear ends of the arms 104, and the pivoting members 101 pivot counterclockwise in a left side view about the pivot shafts 102.

At this time, the pivoting members 101 contact the second step parts 97 of the engaging parts 76 constituting the translation cams 73 from the rear side thereof, pressing the translation cams 73 forward (see FIG. 5). The translation cams 73 slide forward into the second position. Consequently, the translation cams 73 are placed in the second position in conjunction with the opening movement of the front cover 5. On the other hand, when the front cover 5 is closed from its open position, the translation cams 73 does not slide in association with the closing movement of the front cover 5. Hence, the translation cams 73 remain in the second position.

The main casing 2 also has a top access opening 59 formed in the top thereof, and a top cover 60 provided over the top access opening 59 for opening and closing the same. The top access opening 59 serves as an example of second opening, and the top cover 60 serves as an example of second cover.

The top access opening 59 is cut out in the top wall of the main casing 2 and extends from a position above the black developer cartridge 11K to a position above the cyan developer cartridge 11C.

Figure 6:
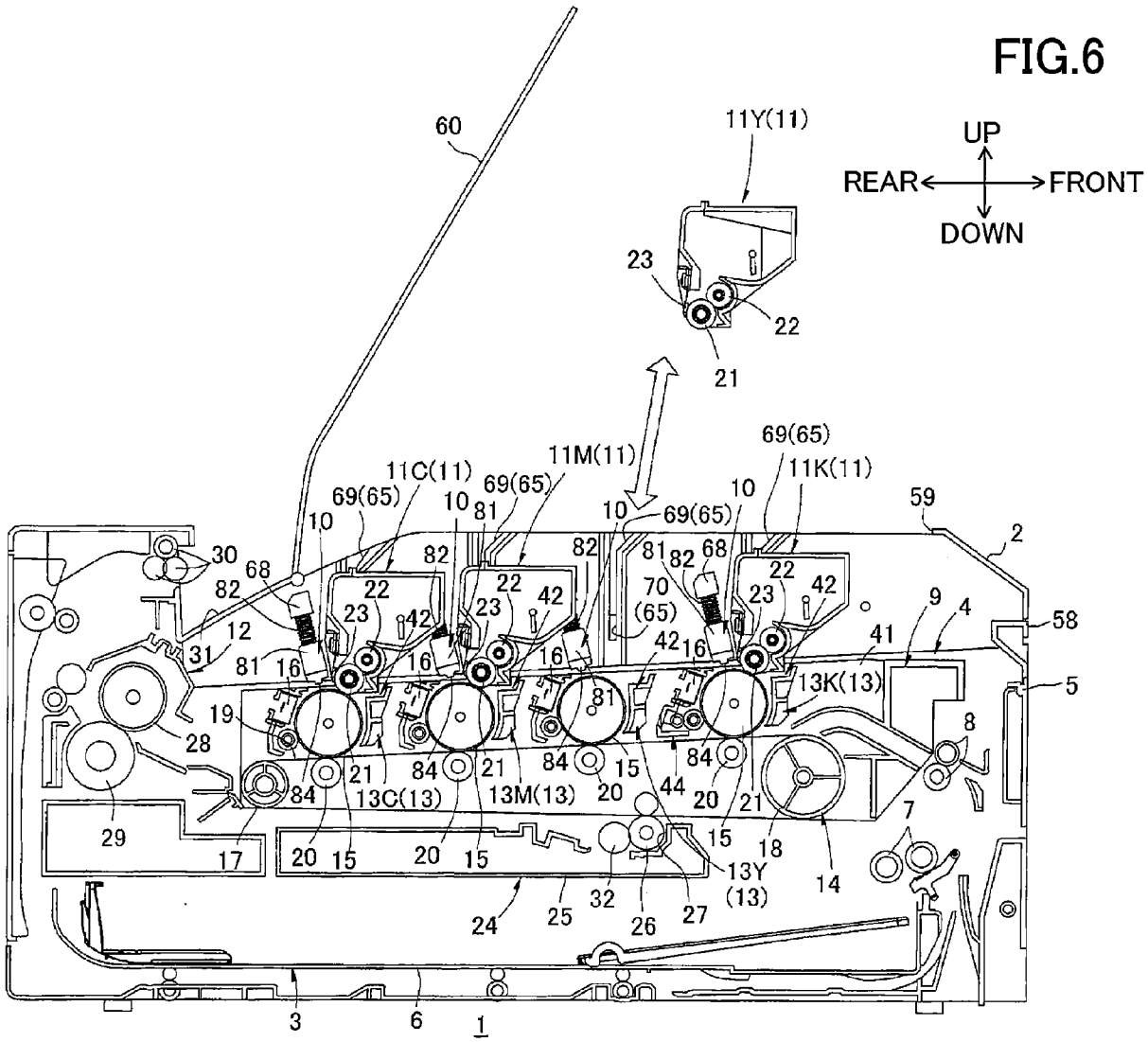
FIG. 6 is an explanatory diagram showing mounting and removing of developer cartridges shown in FIG. 1, in which a yellow developer cartridge is removed after a top cover is opened.

The top cover 60 provided over the top access opening 59 can pivot about its rear edge between a closed position for covering the top access opening 59 and an open position for exposing the top access opening 59 (see FIG. 6). The top cover 60 does not move in association with the translation cam mechanisms 71 (the LED units 10).

3. Drawer Unit

As shown in FIG. 1, the drawer unit 9 includes a pair of left and right side plates 41, as well as the drum units 13 and the transfer unit 14 described earlier. In a side view, the drawer unit 9 is substantially rectangular in shape, with a vertical dimension that grows shorter from front to rear.

The side plates 41 are positioned parallel to one another and are separated in the left-to-right direction. Left and right ends of the drum units 13 and the transfer unit 14 are supported in the side plates 41.

The drum units 13 are detachably mounted in the drawer unit 9. More specifically, guides (not shown) are provided in the side plates 41 of the drawer unit 9 for guiding the left and right ends of the drum units 13 as the drum units 13 are mounted and removed vertically.

Each drum unit 13 is also provided with a drum frame 42 for supporting the respective photosensitive drum 15 and Scorotron charger 16. The drum frames 42 are substantially rectangular frame-like members elongated in the left-to-right direction and open on the top and bottom. The vertical dimension of the drum frame 42 is no greater than the diameter of the photosensitive drum 15. When the drum frame 42 is projected in the front-to-rear direction, the upper edge of the drum frame 42 is substantially flush with the top surface of the corresponding photosensitive drum 15. The Scorotron charger 16 is supported on the rear edge of the corresponding drum frame 42.

The gap between the black drum unit 13K and yellow drum unit 13Y is formed longer than gaps between other adjacent drum units 13. A paper dust cleaner 44 serving as an example of paper dust removing member is provided in the black drum unit 13K at a position beneath the Scorotron charger 16 for removing paper dust from the black photosensitive drum 15.

As described earlier, the transfer unit 14 includes the drive roller 17, follow roller 18, and conveying belt 19. The drive roller 17 is disposed on the rear end of the transfer unit 14.

The follow roller 18 is disposed on the front end of the transfer unit 14 and has a larger diameter than that of the drive roller 17. The central axis of the follow roller 18 is parallel to and aligned with the central axis of the drive roller 17 in the front-to-rear direction.

The conveying belt 19 is formed as a continuous loop that is mounted around the drive roller 17 and follow roller 18. The upper portion of the conveying belt 19 slopes gradually downward from the front side to the rear side, while the lower portion of the conveying belt 19 slopes gradually upward from the front side to the rear side.

As shown in FIG. 3, drawer guide bosses 43 are formed on each side plate 41. Each of the drawer guide bosses 43 is substantially cylindrical in shape and protrudes outward from the left and right outer surfaces of the side plates 41.

By fitting the drawer guide bosses 43 into corresponding drawer guide parts 64 formed in the main casing 2, the drawer unit 9 can be slidably guided by the drawer guide parts 64 in the front-to-rear direction when mounting the drawer unit 9 in the main casing 2.

4. Developer Cartridges

As shown in FIGS. 1 and 3, each developer cartridge 11 is provided with a developer cartridge frame 50. Each developer cartridge frame 50 is formed in a box shape and is elongated in the left-to-right direction. The left-to-right dimension of the developer cartridge frame 50 is shorter than that of the drawer unit 9. The developer cartridge frame 50 is substantially shaped like a trapezoid in a side view such that its vertical dimension is shorter at the front end than the rear end.

More specifically, the developer cartridge frame 50 is configured of a front wall 51, a top wall 52, and a rear wall 53. The upper half of the front wall 51 extends vertically, and the lower half slopes downward toward the rear. The top wall 52 of the developer cartridge frame 50 extends continuously rearward from the upper edge of the front wall 51. The rear wall 53 of the developer cartridge frame 50 extends continuously downward from the rear edge of the top wall 52 such that the bottom edge of the rear wall 53 is aligned with but separated from the bottom edge of the front wall 51 in the front-to-rear direction (and more specifically in a direction angled from the upper rear side to the lower front side).

The corresponding developing roller 21 is rotatably supported in the bottom of the developer cartridge frame 50 between the front wall 51 and rear wall 53.

The developer cartridge frame 50 is also provided with a pair of left and right developer cartridge guide ribs 54 (see FIG. 3) serving as an example of second contact part, with one on each left and right end thereof. The developer cartridge guide ribs 54 are formed as ridges extending linearly along the vertical and protrude outward from the left and right outer end faces of the developer cartridge frame 50.

By fitting the developer cartridge guide ribs 54 of each developer cartridge frame 50 in corresponding developer cartridge guide parts 65 formed in the main casing 2, the developer cartridge 11 can be guided vertically along the developer cartridge guide parts 65 when mounting the developer cartridge 11 in or removing the developer cartridge 11 from the main casing 2.

Note that when the developer cartridge guide ribs 54 are fitted into the exposure openings 70 of the developer cartridge guide parts 65, the lower ends of the developer cartridge guide ribs 54 are exposed on the outside of the developer-side inner wall 63 in the left-to-right direction. When the translation cams 73 are disposed in the first position, the lower ends of the developer cartridge guide ribs 54 oppose the developer-side opposing surfaces 90 of the translation cams 73 with slight gaps formed therebetween (see FIG. 2).

In addition, the developer cartridges 11 are constantly urged downward by springs or other urging means (not shown). Through this constant urging force on the developer cartridges 11, the developing rollers 21 are disposed in a contact position for contacting the corresponding photosensitive drums 15 (see as reference the black developer cartridge 11K in FIG. 12).

When the developer cartridge guide ribs 54 are pressed upward by the translation cams 73, the developer cartridge 11 moves upward against the urging force of the urging means while being guided along the developer cartridge guide parts 65. At this time, the developing roller 21 moves to a separated position, separated from the corresponding photosensitive drum 15 (see all non-black developer cartridges 11 in FIG. 12).

5. LED Units

As shown in FIG. 1, each LED unit 10 has an LED array 81. The LED array 81 extends in the left-to-right direction. A plurality of LEDs 84 is juxtaposed in the left-to-right direction in the bottom of the LED array 81. The LED arrays 81 are longer in the left-to-right direction than the developer cartridges 11.

As shown in FIG. 2, each LED array 81 is provided with a pair of left and right LED guide bosses 83 serving as an example of first contact part. The LED guide bosses 83 are substantially columnar in shape and protrude outward from the left and right ends of the LED array 81.

Each LED array 81 is inserted into a space defined by the rear wall 53 of the corresponding developer cartridge 11, the front wall 51 (and specifically the lower half thereof) of the developer cartridge 11 adjacent on the rear side, and the upper end of the drum unit 13. By fitting the LED guide bosses 83 into the corresponding LED guide parts 67 formed in the developer-side inner walls 63, the LED array 81 is supported in the developer-side inner walls 63 while being slidably guided in the vertical direction by the LED guide parts 67.

With this construction, the LED units 10 do not interfere with the mounting paths of the developer cartridges 11, but overlap the mounted developer cartridges 11 when projected along the direction that the developing rollers 21 oppose the photosensitive drums 15. In other words, the LED units 10 are away from the mounting paths, but overlap the mounted developer cartridges 11 in a direction parallel to a direction that the developing rollers 21 oppose the photosensitive drums 15.

As shown in FIG. 1, each LED unit 10 also includes a pair of left and right compression springs 82. One end of the compression springs 82 is connected to the top surface of the corresponding LED arrays 81 on left and right ends thereof, while the other end is connected to the LED support parts 68 of the main casing 2. The compression springs 82 constantly urge the LED array 81 toward the corresponding photosensitive drum 15, placing the LED array 81 in an adjacent position adjacent to the corresponding photosensitive drum 15 for exposing the same (see as reference the LED array 81 corresponding to the black photosensitive drum 15 in FIG. 12).

When the LED guide bosses 83 of the LED units 10 are in contact with the rear edges of the LED-side pressing surfaces 95 formed on the corresponding LED-side cam parts 80, the LED arrays 81 are moved upward against the urging force of the compression springs 82. Hence, the LED array 81 can be moved to a retracted position separated from the photosensitive drum 15 (see as reference the LED arrays 81 corresponding to all non-black photosensitive drums 15 in FIG. 12).

6. Mounting and Removing the Developer Cartridges and the Drum Units (1) Mounting and Removing the Developer Cartridges To mount the developer cartridge 11 in the main casing 2, the operator grips the front end of the top cover 60 and lifts the front end upward, as shown in FIG. 6, moving the top cover 60 into the open position and exposing the top access opening 59 formed in the main casing 2.

Next, the operator positions the developer cartridge 11 so that the developer cartridge guide ribs 54 are above the developer cartridge guide parts 65 formed in the main casing 2. The operator then inserts the developer cartridge 11 through the top access opening 59 into the main casing 2.

After subsequently moving the top cover 60 into the closed position, the operation for mounting the developer cartridge 11 in the main casing 2 is complete.

To remove the developer cartridge 11 from the main casing 2, the operator places the top cover 60 in the open position and pulls the developer cartridge 11 upward from the main casing 2 through the top access opening 59.

(2) Mounting and Removing the Drum Units

Figure 7:
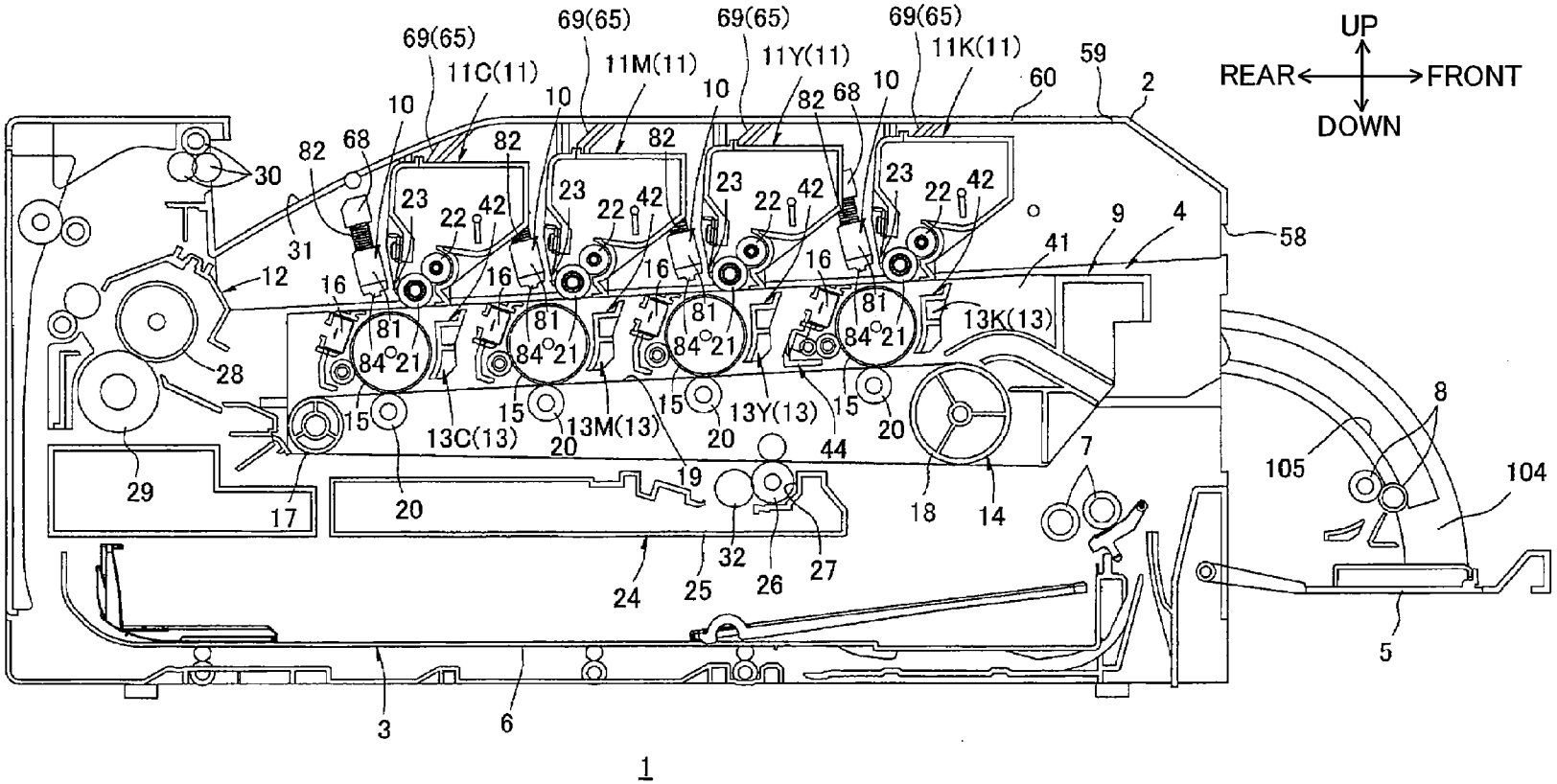
FIG. 7 is an explanatory diagram showing mounting and removing of drum units shown in FIG. 1, in which the front cover is opened.

To mount the drum unit 13 in the main casing 2, the operator grips the top edge of the front cover 5 and pivots the front cover 5 forward, as shown in FIG. 7, placing the front cover 5 in its open position and exposing the access opening 58 formed in the main casing 2.

At this time, the translation cam 73 is moved to the second position in association with the opening operation of the front cover 5, as described earlier. Further, the developer cartridge guide ribs 54 of all developer cartridges 11 are in contact with the developer-side pressing surfaces 92 of the corresponding developer-side cam parts 79, and the LED guide bosses 83 of all LED units 10 are in contact with the LED-side pressing surfaces 95 of the corresponding LED-side cam parts 80 (see FIG. 9).

Through this operation, all developer cartridges 11 are moved upward against the urging force of the urging members (not shown) and are disposed in the separated position. In addition, all LED units 10 are moved upward against the urging force of the compression springs 82 and are disposed in the retracted positions.

Figure 8:
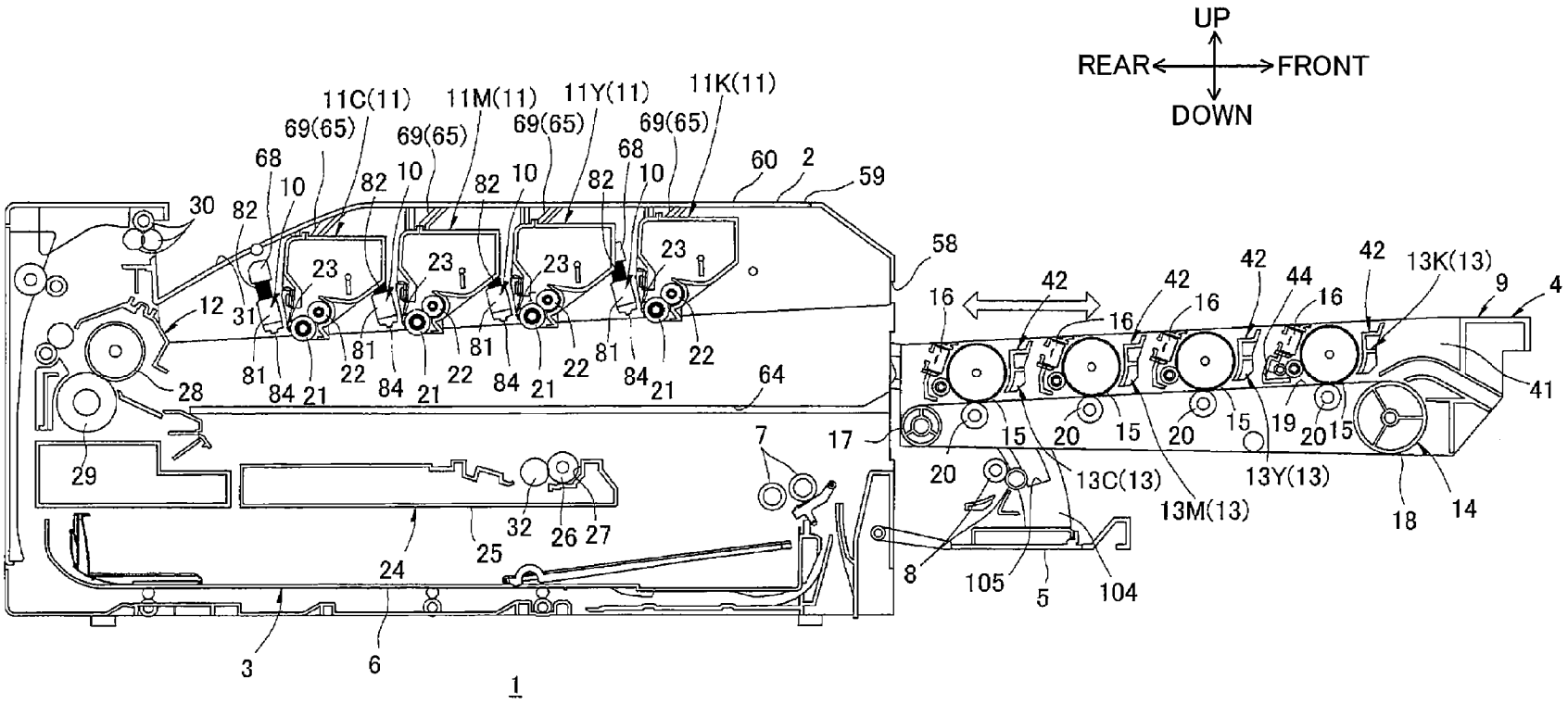
FIG. 8 is an explanatory diagram showing inserting and withdrawing of a drawer unit shown in FIG. 1, in which the drawer unit is withdrawn after the state in FIG. 7.

Next, the operator pulls the drawer unit 9 forward through the access opening 58 into the withdrawn position, as illustrated in FIG. 8.

In this state, the operator can mount and remove each of the drum units 13 in the top of the drawer unit 9. Subsequently, the operator pushes the drawer unit 9 rearward to insert the drawer unit 9 through the access opening 58 into the main casing 2.

After moving the front cover 5 back to the closed position, the operation for mounting the drum unit 13 in or removing the drum unit 13 from the main casing 2 is complete.

6. Image-Forming Operation

The color printer 1 of this embodiment can be switched among a standby mode (see FIG. 9) in which the color printer 1 is ready for image formation, a monochrome print mode (see FIG. 11) for forming images in black only, and a color print mode (see FIG. 2) for forming color images.

(1) Standby Mode

Figure 9:
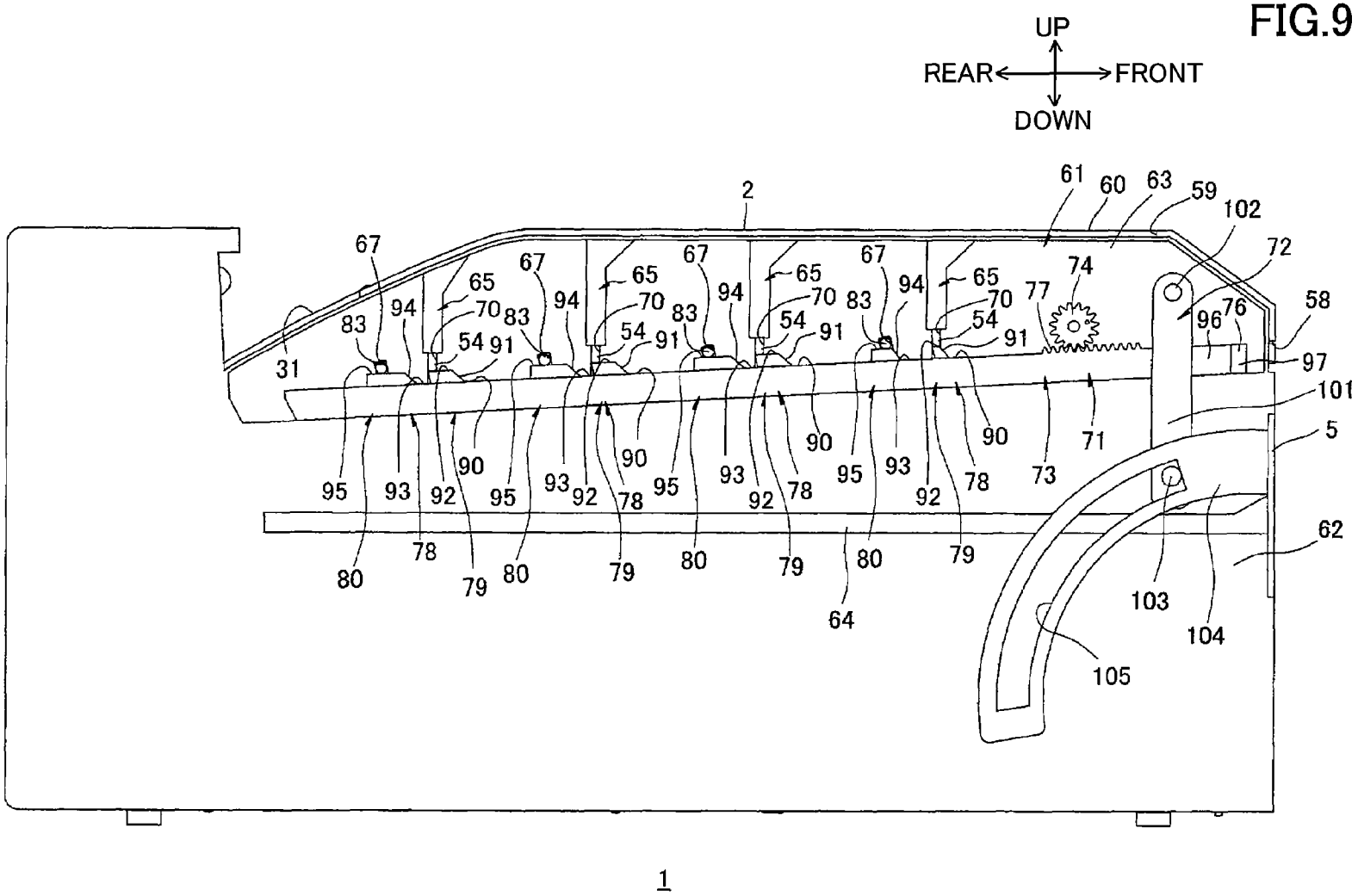
FIG. 9 is an explanatory diagram showing standby mode of the color printer shown in FIG. 1, in which the translation cams are placed in the second position.
Figure 10:
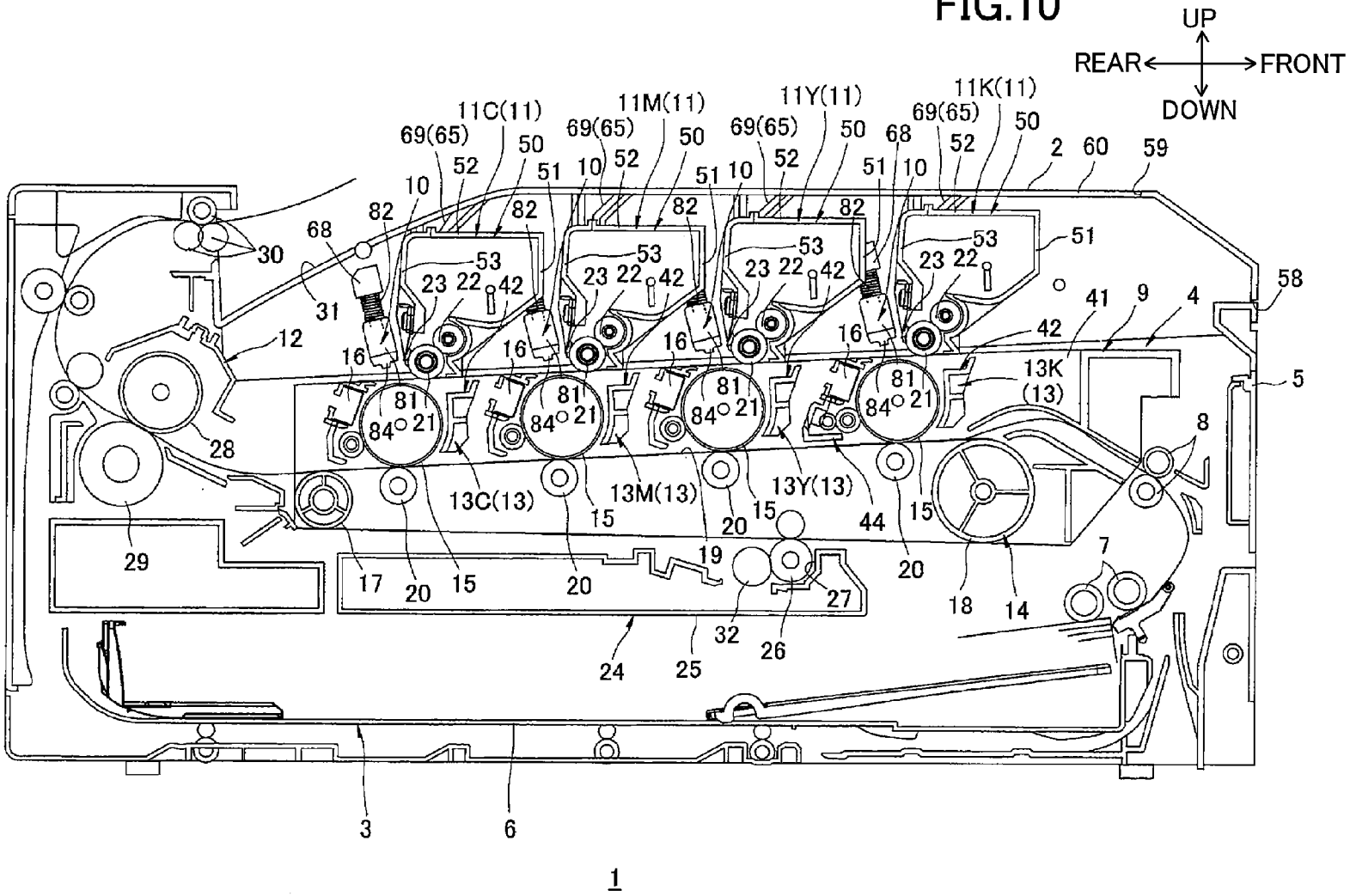
FIG. 10 is an explanatory diagram showing the standby mode of the color printer shown in FIG. 1, in which all developer cartridges are disposed in a separated position and all LED units are disposed in a retracted position.

After mounting the drum units 13 and closing the front cover 5 as described above, the translation cams 73 are in the second position shown in FIG. 9, and the color printer 1 is in the standby mode. In the standby mode, all developer cartridges 11 are disposed in the separated position and all LED units 10 are disposed in the refracted position, as shown in FIG. 10.

(2) Monochrome Print Mode

Figure 11:
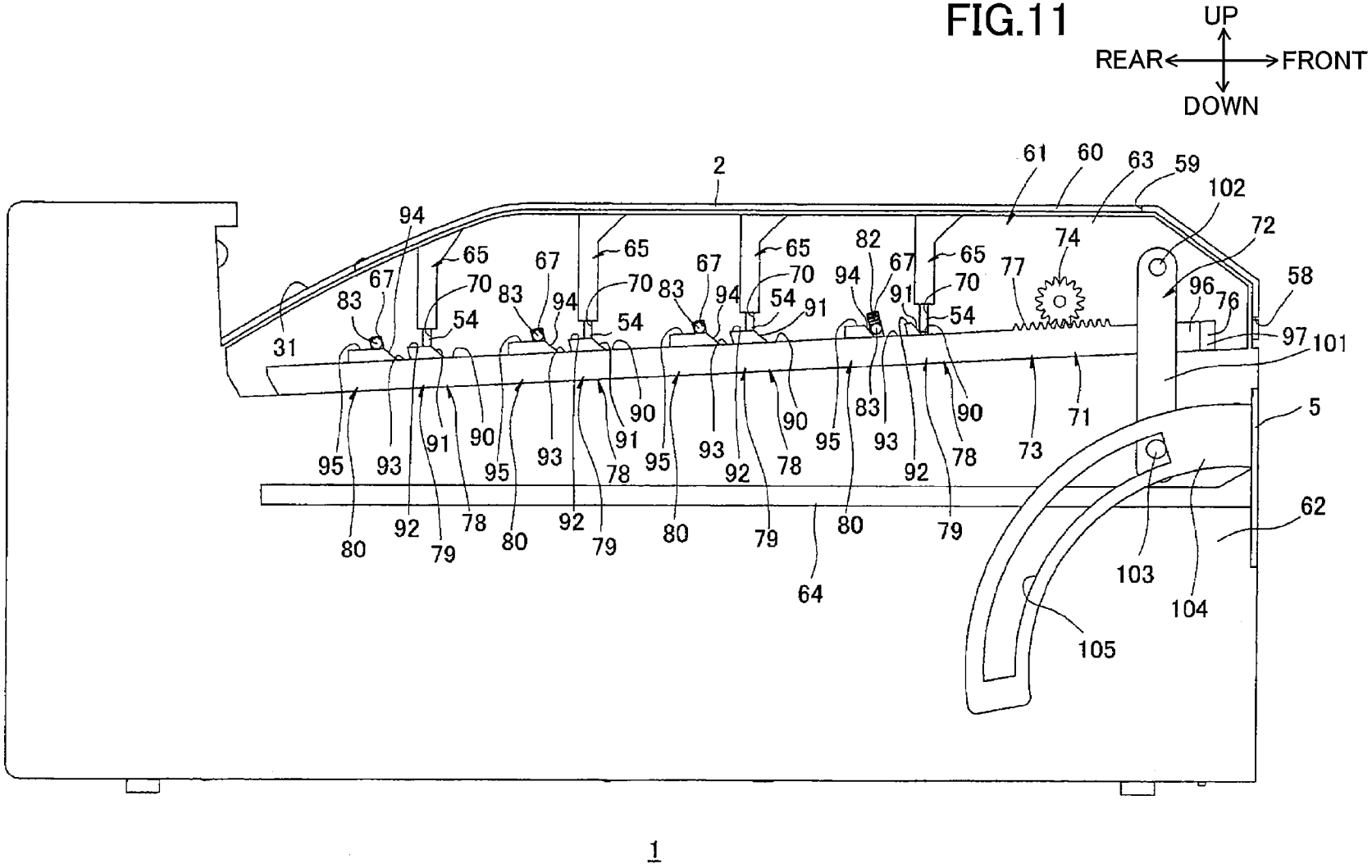
FIG. 11 is an explanatory diagram showing monochrome print mode of the color printer shown in FIG. 1, in which the translation cams are placed in a third position.

When the color printer 1 changes from the standby mode to the monochrome print mode, the translation cam drive gears 74 is rotated clockwise in a left side view by a driving source (not shown), sliding the translation cams 73 rearward from the second position into the third position shown in FIG. 11.

At this time, the developer cartridge guide ribs 54 of the black developer cartridge 11K are guided along the developer-side sloped surfaces 91 of the corresponding developer-side cam parts 79 and move to a position opposing the developer-side opposing surfaces 90. Since the developer cartridge guide ribs 54 no longer contact the developer-side pressing surfaces 92, the urging force of the urging members (not shown) move the developing roller 21 of the black developer cartridge 11K into the contact position.

In addition, the LED guide bosses 83 of the LED units 10 corresponding to the black photosensitive drum 15 are guided along the LED-side sloped surfaces 94 of the LED-side cam part 80 to a position opposing the LED-side opposing surfaces 93. Since the LED guide bosses 83 no longer contact the LED-side pressing surfaces 95, the urging force of the compression springs 82 moves the LED array 81 of the LED unit 10 corresponding to the black photosensitive drum 15 into the adjacent position.

At this time, the developer cartridge guide ribs 54 of all non-black developer cartridges 11 contact the front end of the developer-side pressing surfaces 92 formed on the corresponding developer-side cam parts 79. Accordingly, the developing rollers 21 of all non-black developer cartridges 11 are maintained in the separated position.

The LED guide bosses 83 of LED units 10 corresponding to non-black photosensitive drums 15 also contact the front ends of the LED-side pressing surfaces 95 formed on the corresponding LED-side cam parts 80. Accordingly, the LED arrays 81 of the LED units 10 corresponding to non-black photosensitive drums 15 are maintained in the retracted position.

In this way, the color printer 1 is shifted into the monochrome print mode.

(3) Color Print Mode

When changing the color printer 1 from the monochrome print mode to the color print mode, the translation cam drive gears 74 is rotated clockwise in a left side view by the driving source (not shown), sliding the translation cams 73 rearward from the third position into the first position shown in FIG. 2. Hence, the developer cartridge guide ribs 54 of the non-black developer cartridges 11 are guided along the developer-side sloped surfaces 91 formed on the corresponding developer-side cam parts 79 to positions opposing the developer-side opposing surfaces 90, as shown in FIG. 1. Since the developer cartridge guide ribs 54 no longer contact the developer-side pressing surfaces 92, the urging force of the urging members (not shown) move the non-black developer cartridges 11 into their contact positions. At this time, the developing rollers 21 of all developer cartridges 11 are in the contact position.

Similarly, the LED guide bosses 83 of the LED unit 10 corresponding to the black photosensitive drum 15 are guided along the LED-side sloped surfaces 94 of the LED-side cam parts 80 to positions opposing the LED-side opposing surfaces 93. Since the LED guide bosses 83 no longer contact the LED-side pressing surfaces 95, the urging force of the compression springs 82 moves the LED unit 10 corresponding to the black photosensitive drum 15 into the adjacent position. At this time, the LED arrays 81 of all LED units 10 are in their adjacent positions.

Through this process, the color printer 1 is shifted into the color print mode.

Figure 12:
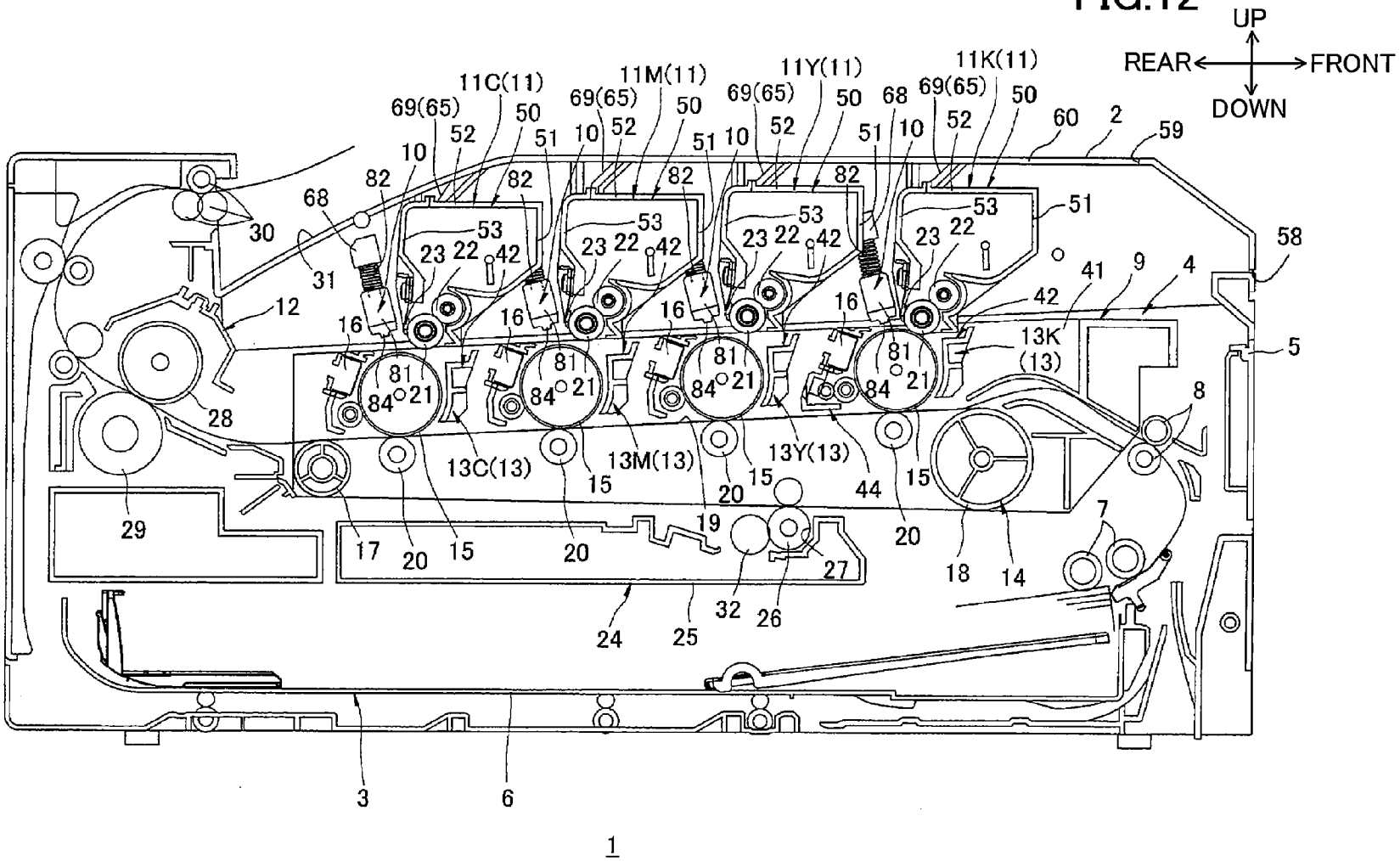
FIG. 12 is an explanatory diagram showing the monochrome print mode of the color printer shown in FIG. 1, in which all non-black developer cartridges are maintained in the separated position and the LED units corresponding to non-black photosensitive drums are maintained in the retracted position.

8. Operations and Effects (1) With the color printer 1 according to the first embodiment, the translation cams 73 can move the LED units 10 to the adjacent position adjacent to the corresponding photosensitive drums 15 for exposing the same and to the retracted position separated from the photosensitive drums 15, as illustrated in FIG. 12. Accordingly, the LED units 10 can be separated from and brought near the photosensitive drums 15 through a simple construction, without needing to provide the LED units 10 in the top cover 60.

(2) With the color printer 1 according to the first embodiment, the translation cams 73 are each provided with the LED-side sloped surfaces 94 interposed between respective LED-side opposing surfaces 93 and LED-side pressing surfaces 95 for guiding movement of the respective LED units 10, as shown in FIG. 2. The LED-side sloped surfaces 94 facilitate the smooth movement of LED units 10 between the LED-side opposing surfaces 93 and LED-side pressing surfaces 95.

(3) With the color printer 1 according to the first embodiment, the translation cams 73 can be moved between the first position in which all LED units 10 are disposed in the adjacent position, and the second position in which all LED units 10 are disposed in the refracted position, as shown in FIGS. 2 and 9. Therefore, the LED units 10 can easily be retracted simply by moving the translation cams 73 from the first position to the second position.

(4) With the color printer 1 according to the first embodiment, the translation cams 73 can be moved to the third position in which the LED unit 10 corresponding to the black photosensitive drum 15 is disposed in the adjacent position and the other LED units 10 are disposed in the retracted position, as shown in FIG. 11. Hence, the color printer 1 can print monochrome images simply by moving the translation cams 73 to the third position.

(5) With the color printer 1 according to the first embodiment, the translation cams 73 can move the developer cartridges 11 between the contact position in which the respective developing rollers 21 contact the corresponding photosensitive drums 15, and the separated position in which the developing rollers 21 are separated from the photosensitive drums 15, as shown in FIGS. 1 and 10. Hence, the translation cams 73 can be used not only to separate the LED units 10 from and bring the LED units 10 adjacent to the photosensitive drums 15, but also to separate the developing rollers 21 from and bring the developing rollers 21 into contact with the photosensitive drums 15.

(6) With the color printer 1 according to the first embodiment, the translation cams 73 are provided with developer-side sloped surfaces 91 interposed between the respective developer-side opposing surfaces 90 and developer-side pressing surfaces 92 for guiding movement of the developer cartridges 11. The developer-side sloped surfaces 91 facilitate the smooth movement of the developer cartridges 11 between the respective developer-side opposing surfaces 90 and developer-side pressing surfaces 92.

(7) With the color printer 1 according to the first embodiment, the drawer unit 9 slides through the access opening 58 between the mounted position and the withdrawn position, and the developer cartridges 11 are mounted in the main casing 2 through the top access opening 59 formed separately from the access opening 58. Thus, the drum units 13 can be replaced by pulling only the drawer unit 9 out through the access opening 58 and without having to remove the developer cartridges 11.

Further, when replacing the developer cartridges 11, it is possible to replace only the developer cartridges 11 through the top access opening 59, without having to slide the drawer unit 9 out of the main casing 2. In this way, the drum units 13 and developer cartridges 11 can be replaced more efficiently.

(8) As shown in FIG. 1, the LED units 10 of the color printer 1 according to the first embodiment are disposed in positions that overlap the corresponding developer cartridges 11 mounted in the main casing 2 when the components are projected along the direction in which the developing rollers 21 confront the photosensitive drums 15, but the LED units 10 do not interfere with (separated from) the developer cartridge 11 when the developer cartridges 11 are mounted and removed. In other words, each of the LED units 10 is arranged to overlap with the corresponding developer cartridge 11 in the direction in which the developing rollers 21 confront the photosensitive drums 15, but the LED units 10 do not interfere with the developer cartridge 11 when the developer cartridges 11 are mounted and removed. Accordingly, it is possible to reduce the gap between adjacent developer cartridges 11 in the direction orthogonal to the direction that the developing rollers 21 confront the photosensitive drums 15, thereby making the color printer 1 more compact.

(9) As shown in FIGS. 4 and 7, the translation cams 73 of the color printer 1 move the respective LED units 10 from the adjacent position to the retracted position in conjunction with the movement of the front cover 5 from the closed position to the open position. Hence, the operation for moving the front cover 5 to the open position in order to withdraw the drawer unit 9 also serves to move the LED units 10 from the adjacent position to the retracted position. This construction prevents the LED units 10 from interfering with the drawer unit 9 when the drawer unit 9 is pulled out of the main casing 2.

(10) As shown in FIG. 1, the drum frames 42 are positioned such that their top edges are flush with the top surfaces of the photosensitive drums 15. In other words, the top edges of the drum frames 42 are linearly aligned with the top surface of the photosensitive drums 15. Hence, this construction prevents the LED units 10 from interfering with the drum frames 42 of the drum units 13 when removing the drawer unit 9.

(11) As shown in FIGS. 4 and 7, the translation cams 73 move the developer cartridges 11 from the contact position to the separated position in association with the movement of the front cover 5 from the closed position to the open position. Hence, the movement of the front cover 5 to the open position for removing the drawer unit 9 can also serve to move the developer cartridges 11 from the contact position to the separated position. This construction can prevent the developer cartridges 11 from interfering with the drawer unit 9 when the drawer unit 9 is withdrawn.

(12) As shown in FIG. 3, the length of the developer cartridges 11 in the left-to-right direction is set shorter than the length of the drawer unit 9 in the same direction. Hence, space in the main casing 2 on both left and right sides of the developer cartridges 11 (space on the outer left and right sides of the developer-side inner walls 63) can be used effectively.

(13) As shown in FIG. 8, the transfer unit 14 slides together with the drawer unit 9. Thus, the transfer unit 14 can easily be replaced.

(14) As shown in FIG. 1, the follow roller 18 positioned on the front side has a larger diameter than the drive roller 17 positioned on the rear side, and the lower portion of the conveying belt 19 slopes upward from the front side toward the rear side. Hence, even when the belt cleaning roller 26 is provided for contacting the lower portion of the conveying belt 19 from below, the lower portion of the conveying belt 19 can easily separate from the belt cleaning roller 26 in a forward direction. Consequently, the drawer unit 9 can easily be withdrawn from the main casing 2, even when the belt cleaning roller 26 is provided.

(15) As shown in FIG. 1, the paper dust cleaner 44 is disposed in confrontation with the black photosensitive drum 15 for removing paper dust from the same. Therefore, paper dust can be efficiently removed from the black photosensitive drum 15, which is the photosensitive drum most susceptible to deposition of paper dust.

(16) As shown in FIG. 6, the top cover 60 provided in the color printer 1 can move independently of the LED units 10. Hence, the top cover 60 can easily be opened and closed.

9. Second Embodiment

In the first embodiment described above, the color printer 1 is configured as a direct tandem color printer. In the second embodiment, a color printer 111 is configured as an intermediate transfer color printer. In the color printer 111 according to the second embodiment, like parts and components are designated with the same reference numerals used for the color printer 1 of the first embodiment to avoid duplicating description.

(1) Color Printer According to the Second Embodiment

Figure 13:
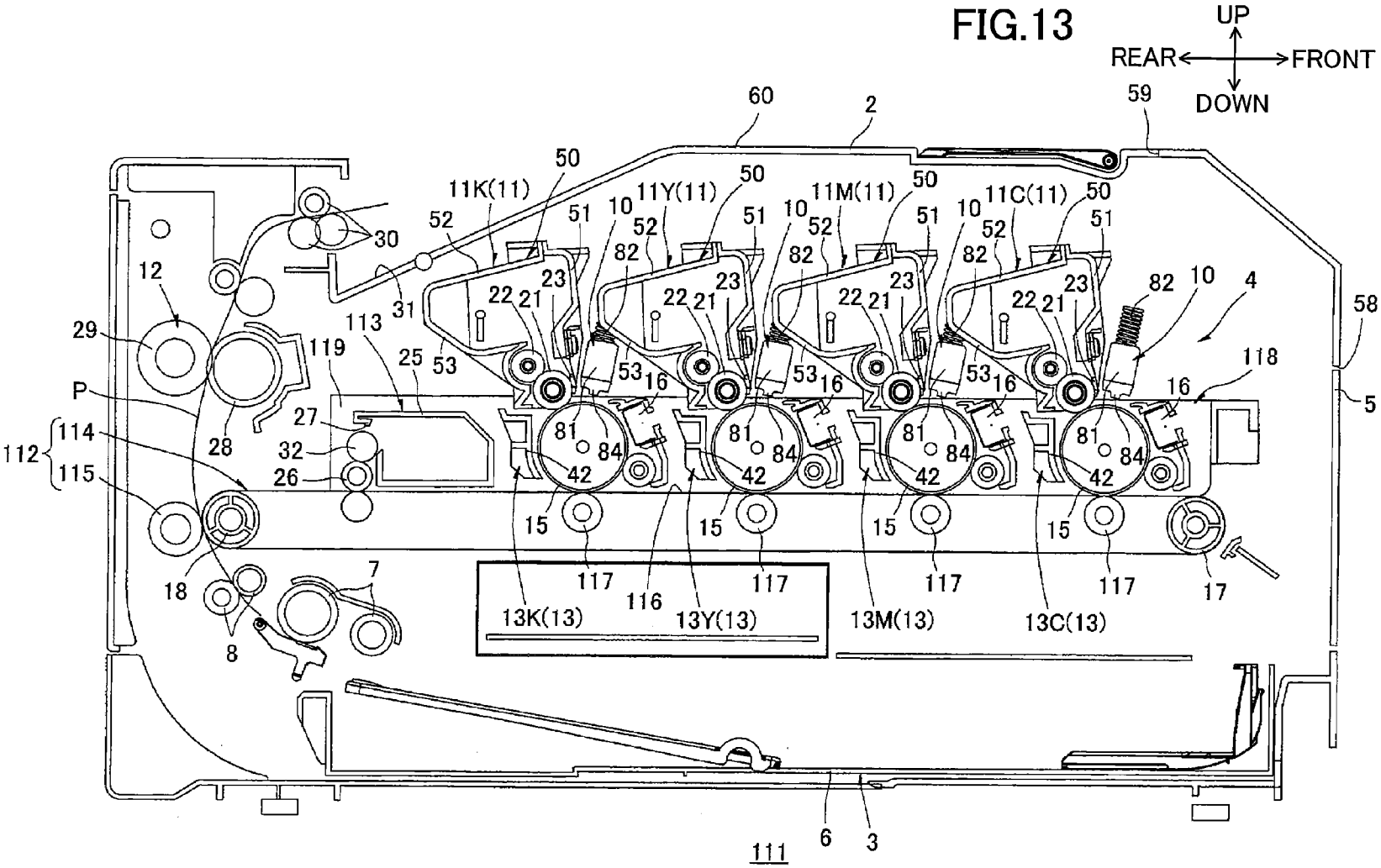
FIG. 13 is a cross-sectional view of an intermediate transfer color printer according to a second embodiment of the present invention.

As shown in FIG. 13, the color printer 111 serving as a second embodiment of the image-forming apparatus according to the present invention is a horizontal-type intermediate transfer color printer. The color printer 111 includes the main casing 2 and, within the main casing 2, the sheet-feeding unit 3 for feeding sheets of paper P to be printed, and the image-forming unit 4 for forming images on the sheets of paper P fed by the sheet-feeding unit 3.

The sheet-feeding unit 3 includes a pair of feeding rollers 7 disposed above the rear edge of the paper tray 6.

The feeding rollers 7 rotate to feed sheets of paper P accommodated in the paper tray 6 one sheet at a time toward the pair of registration rollers 8, and the registration rollers 8 convey the sheets at a prescribed timing toward the image-forming unit 4 (and specifically between an intermediate transfer belt and a secondary transfer roller described later).

The image-forming unit 4 is disposed above the sheet-feeding unit 3. The image-forming unit 4 includes four drum units 13 corresponding to each of the printing colors, four developer cartridges 11 corresponding to the printing colors, a transfer unit 112, and a belt cleaning unit 113 serving as an example of cleaning unit.

The drum units 13 are arranged parallel to one another and are spaced at intervals in the front-to-rear direction. More specifically, the drum units 13 include the black drum unit 13K, the yellow drum unit 13Y, the magenta drum unit 13M, and the cyan drum unit 13C arranged from the rear side to the front side in the given order.

The developer cartridges 11 are arranged parallel to one another and are spaced at intervals in the front-to-rear direction. The developer cartridges 11 are positioned above the corresponding photosensitive drums 15. More specifically, the developer cartridges 11 include the black developer cartridge 11K, the yellow developer cartridge 11Y, the magenta developer cartridge 11M, and the cyan developer cartridge 11C arranged from the rear side toward the front side in the given order.

The transfer unit 112 includes a belt unit 114, and a secondary transfer roller 115. The belt unit 114 is disposed beneath the drawer unit 9 and oriented in the front-to-rear direction. The belt unit 114 includes the drive roller 17, the follow roller 18, an endless intermediate transfer belt 116 serving as an example of endless belt, and four primary transfer rollers 117. The drive roller 17 and follow roller 18 are arranged parallel to each other and separated in the front-to-rear direction.

The intermediate transfer belt 116 is looped around the drive roller 17 and follow roller 18 so that the outer surface on the upper portion of the intermediate transfer belt 116 vertically opposes and contacts the photosensitive drums 15. When the drive roller 17 is driven to rotate, the intermediate transfer belt 116 circularly moves so that the upper portion contacting the photosensitive drums 15 moves rearward.

The primary transfer rollers 117 are disposed at positions confronting the corresponding photosensitive drums 15, with the upper portion of the intermediate transfer belt 116 interposed therebetween.

The secondary transfer roller 115 is disposed to the rear of the belt unit 114 and confronts the follow roller 18 of the belt unit 114 with the intermediate transfer belt 116 interposed therebetween.

The belt cleaning unit 113 is disposed to the rear of the black drum unit 13K. The belt cleaning unit 113 includes the waste toner collecting unit 25, the belt cleaning rollers 26, and the scraping roller 32.

The waste toner collecting unit 25 is formed substantially in a box shape and has an opening formed in the rear end portion thereof.

The belt cleaning rollers 26 are rotatably supported in the lower rear end portion of the waste toner collecting unit 25. The belt cleaning unit 113 is positioned such that the belt cleaning roller 26 contacts the upper portion of the intermediate transfer belt 116 from above. With the belt cleaning unit 113 having this construction, the belt cleaning rollers 26 clean toner and other matter deposited on the surface of the intermediate transfer belt 116, the scraping roller 32 scrapes the toner and other matter from the belt cleaning rollers 26, and the waste toner collecting unit 25 accommodates the toner and the like scraped off the belt cleaning roller 26 by the scraping roller 32.

(2) Transferring Operation According to the Second Embodiment

In a primary transfer operation, toner images formed on the surfaces of the photosensitive drums 15 through reversal development are sequentially transferred onto the upper portion of the intermediate transfer belt 116, as the intermediate transfer belt 116 moves in a forward direction. Through this primary transfer, a color image is formed on the intermediate transfer belt 116.

In a secondary transfer operation, the color image formed on the intermediate transfer belt 116 is subsequently transferred onto a sheet of paper P conveyed from the sheet-feeding unit 3, as the sheet passes through the position at which the intermediate transfer belt 116 confronts the secondary transfer roller 115.

(3) Drawer Unit

The color printer 111 according to the second embodiment also includes a drawer unit 118 serving as an example of moving member. The drawer unit 118 includes is the drum units 13, the belt cleaning unit 113, and a pair of left and right side plates 119.

The drum units 13 and the belt cleaning unit 113 are integrally supported between a pair of left and right side plates 119.

The vertical dimension of the belt cleaning unit 113 is set smaller than the diameter of the photosensitive drums 15, and the belt cleaning unit 113 is positioned such that its upper edge is lower than the upper surfaces of the photosensitive drums 15.

With the color printer 111 according to the second embodiment, the belt cleaning unit 113 is provided in the drawer unit 118. When the drawer unit 118 is pulled out of the main casing 2 in this configuration, the LED units 10 do not obstruct the belt cleaning unit 113.

The color printer 111 according to the second embodiment achieves the same operations and effects described in the first embodiment.

While the present invention has been described in detail with reference to the embodiments thereof, it would be apparent to those skilled in the art that various changes and modifications may be made therein without departing from the spirit of the invention.

What is claimed is:

1. An image-forming apparatus comprising:

a main casing formed with a first opening and a second opening, the second opening being formed separately from the first opening;

a photosensitive drum having a rotation axis extending in an axial direction and configured to rotate about the rotation axis;

a moving member configured to move in a first direction from a mounted position in which the moving member is mounted in the main casing to a withdrawn position in which the moving member is withdrawn to an outside of the main casing, the first direction being perpendicular to the axial direction and parallel to a horizontal direction, the moving member being configured to support the photosensitive drum;

a developing cartridge including a developing roller and configured to supply developer to the photosensitive drum;

a first cover configured to pivotally move about a pivot shaft between a closed position covering the second opening and an open position exposing the second opening, the pivot shaft extending in the axial direction;

a fixing device including a heating roller and a pressure roller; and a discharge roller configured to discharge a sheet of paper toward the first cover, wherein the developing cartridge is configured to be detachably mounted in the main casing through the second opening in a vertical direction, wherein the moving member is configured to move from the mounted position to the withdrawn position through the first opening while the developing cartridge remains mounted in the main casing, and wherein the discharge roller and the pressure roller define a first distance therebetween, the discharge roller and the pivot shaft defining a second distance therebetween, the first distance being greater than the second distance.

2. The image-forming apparatus according to claim 1, wherein the first opening is positioned downstream, in the first direction, of the moving member positioned in the mounted position.

3. The image-forming apparatus according to claim 2, further comprising a second cover configured to move between a closed position covering the first opening and an open position exposing the first opening, wherein the main casing has a wall portion, the first opening being separated from the second opening by the wall portion.

4. The image-forming apparatus according to claim 1, further comprising a belt unit including an endless belt configured to contact the photosensitive drum, the belt unit being configured to move together with the moving member.

5. The image-forming apparatus according to claim 1, wherein the main casing includes:

a first guide configured to guide a movement of the developing cartridge when the developing cartridge is detached from and when the developing cartridge is mounted in the main casing; and a second guide configured to guide a movement of the moving member in the first direction.

6. An image-forming apparatus comprising:

a main casing formed with a first opening and a second opening, the second opening being formed separately from the first opening;

a plurality of photosensitive drums arranged to be juxtaposed with each other in a first direction parallel to a horizontal direction;

a belt unit including an endless belt configured to contact the plurality of photosensitive drums, the belt unit being configured to move in the first direction from a mounted position in which the belt unit is mounted in the main casing to a withdrawn position in which the belt unit is withdrawn to an outside of the main casing, the belt unit being configured to move in a direction opposite to the first direction from the withdrawn position to the mounted position, the belt unit being configured to move between the mounted position and the withdrawn position through the first opening;

a plurality of developer cartridges provided in one-to-one correspondence with the plurality of photosensitive drums, the plurality of developer cartridges being arranged in juxtaposition with each other in the first direction, each one of the plurality of developer cartridges being configured to accommodate developer to be supplied to a corresponding one of the plurality of photosensitive drums, each of the plurality of developer cartridges being configured to be mounted in the main casing through the second opening in a second direction parallel to a vertical direction and detached from the main casing through the second opening in a direction opposite to the second direction; and a plurality of exposure units provided in one-to-one correspondence with the plurality of photosensitive drums, the plurality of exposure units being arranged in juxtaposition with each other in the first direction, each one of the plurality of exposure units being disposed adjacent to each one of the plurality of developer cartridges in the first direction such that the plurality of exposure units and the plurality of developing cartridges are alternately aligned in the first direction, wherein each of the plurality of developer cartridges are mountable in and detachable from the main casing through the second opening in the second direction parallel to the vertical direction and in a direction opposite to the second direction, respectively, while the plurality of exposure units and the plurality of developing cartridges are alternately aligned in the first direction.

7. The image-forming apparatus according to claim 6, further comprising a first cover configured to move between a closed position for covering the first opening and an open position for exposing the first opening.

8. The image-forming apparatus according to claim 7, further comprising a second cover configured to move between a closed position for covering the second opening and an open position exposing the second opening.

9. The image-forming apparatus according to claim 8, wherein the plurality of exposure units is stationary when the second cover is moved from the closed position to the open position, the plurality of exposure unit remains mounted in the main casing when the second cover is in the open position.

10. The image-forming apparatus according to claim 8, wherein the second cover comprises a discharge tray.

11. The image-forming apparatus according to claim 6, further comprising a moving member configured to support the plurality of photosensitive drums and the belt unit, the moving member being configured to move in the first direction from the mounted position to the withdrawn position and to move in the direction opposite to the first direction from the withdrawn position to the mounted position, the moving member being configured to move between the mounted position and the withdrawn position through the first opening.

12. The image-forming apparatus according to claim 11, wherein the moving member comprises a cleaning unit including a cleaning member configured to contact an outer surface of the endless belt to clean the endless belt, the cleaning unit being disposed at a side that is a side at which the plurality of photosensitive drums are provided with respect to the endless belt, and wherein the cleaning unit has a dimension in a direction perpendicular to the outer surface of the endless belt, the dimension of the cleaning unit being smaller than a diameter of each of the plurality of photosensitive drums.

13. The image-forming apparatus according to claim 11, wherein the endless belt is configured to convey a sheet of paper in the direction opposite to the first direction to bring the sheet of paper into contact with the plurality of photosensitive drums, wherein the plurality of photosensitive drums is juxtaposed with gaps between neighboring photosensitive drums, the plurality of photosensitive drums including a first photosensitive drum positioned most downstream in the first direction and a second photosensitive drum next to the first photosensitive drum, a first gap between the first photosensitive drum and the second photosensitive drum being longer than any one of remaining gaps, and wherein the moving member includes a paper dust removing member configured to remove paper dust and disposed in confrontation with the first photosensitive drum.

14. The image-forming apparatus according to claim 6, further comprising a cleaning member, wherein the belt unit further includes a pair of rollers arranged in parallel to each other and spaced apart from each other in the first direction, the endless belt being looped around the pair of rollers such that the endless belt is circularly movable upon rotation of the pair of rollers, the endless belt configured to contact each of the plurality of photosensitive drums in a contact direction and having one side portion and another side portion opposite to the one side portion in the contact direction, wherein the plurality of photosensitive drums is configured to contact an outer surface of the one side portion of the endless belt, and the cleaning member is configured to contact an outer surface of the other side portion of the endless belt to clean the endless belt, wherein the pair of rollers includes one roller and another roller, the one roller being disposed on a downstream side of the other roller in the first direction and having a diameter larger than that of the other roller, and wherein the other side portion of the endless belt has an upstream end and a downstream end in the first direction and slopes gradually closer to the one side portion from the downstream end to the upstream end.

15. The image-forming apparatus according to claim 6, wherein the main casing has a pair of inner walls spaced apart from each other in a third direction orthogonal to the first direction and the second direction, each of the pair of inner walls having a plurality of guide parts, each of the plurality of guide parts being in a form of a groove-like recess and configured to guide one of the plurality of developer cartridges toward corresponding one of the plurality of photosensitive drums.

16. The image-forming apparatus according to claim 15, each of the plurality of guide parts includes:

a first portion extending in the second direction; and a second portion positioned upstream of the first portion in the second direction, the second portion having a dimension in the first direction greater than that of the first portion.

17. The image-forming apparatus according to claim 16, wherein the dimension of the second portion is gradually decreased toward a downstream side thereof in the second direction.

18. The image-forming apparatus according to claim 6, wherein each of the plurality of developer cartridges includes a developing roller.

19. The image-forming apparatus according to claim 6, wherein the endless belt is an intermediate transfer belt.

* * * * *